US006042470A

United States Patent [19]

Geib et al.

[11] Patent Number: 6,042,470

[45] Date of Patent: Mar. 28, 2000

[54] COIN SORTER

[75] Inventors: Joseph J. Geib, Mt. Prospect; Scott D. Casanova, Roselle; Douglas U. Mennie, Barrington; Richard A. Mazur, Naperville; Gary P. Watts, Buffalo Grove, all of Ill.

[73] Assignee: Cummins-Allison Corp., Mt. Prospect, Ill.

[21] Appl. No.: 08/824,450

[22] Filed: Apr. 18, 1997

Related U.S. Application Data

[62] Division of application No. 08/587,849, Jan. 11, 1996, Pat. No. 5,865,673.

[51] Int. Cl.[7] ..... G07D 3/16

[52] U.S. Cl. ..... 453/10

[58] Field of Search ..... 453/6, 10; 194/317, 194/318

[56] References Cited

U.S. PATENT DOCUMENTS

| | | | |
|---|---|---|---|
| 3,559,789 | 2/1971 | Hastie et al. . | |
| 3,672,481 | 6/1972 | Hastie et al. . | |
| 3,788,440 | 1/1974 | Propice et al. . | |
| 3,795,252 | 3/1974 | Black . | |
| 3,910,394 | 10/1975 | Fujita . | |
| 3,921,003 | 11/1975 | Greene | 250/557 |
| 3,978,962 | 9/1976 | Gregory, Jr. . | |
| 3,980,168 | 9/1976 | Knight et al. . | |
| 3,998,237 | 12/1976 | Kressin et al. . | |
| 4,086,928 | 5/1978 | Ristvedt et al. | 453/6 |
| 4,098,280 | 7/1978 | Ristvedt et al. | 435/10 |
| 4,111,216 | 9/1978 | Brisebarre . | |
| 4,172,462 | 10/1979 | Uchida et al. | 453/6 |
| 4,178,502 | 12/1979 | Zimmerman | 235/92 |
| 4,234,003 | 11/1980 | Ristvedt et al. . | |
| 4,234,072 | 11/1980 | Prumm . | |
| 4,250,904 | 2/1981 | Leuschen . | |
| 4,254,857 | 3/1981 | Levasseur et al. . | |
| 4,275,751 | 6/1981 | Bergman . | |
| 4,326,621 | 4/1982 | Davies . | |
| 4,353,452 | 10/1982 | Shah et al. . | |

(List continued on next page.)

FOREIGN PATENT DOCUMENTS

| | | | |
|---|---|---|---|
| 0 149 906 A2 | 7/1985 | European Pat. Off. . | |
| 0 301 683 A2 | 2/1989 | European Pat. Off. . | |
| 0061302 | 9/1989 | European Pat. Off. . | |
| 0 702 337 | 3/1996 | European Pat. Off. | G07D 3/12 |
| 2614560 | 10/1977 | Germany . | |
| 3808159 | 3/1988 | Germany . | |

(List continued on next page.)

OTHER PUBLICATIONS

Brandt "Coin Sorter and Counter" Model 970 (Publication Date before Jan. 11, 1995) 1 page.

Brandt "Coin Sorter/Counter" 95 Series (Publication Date before Jan. 11, 1995) 1 page.

Brandt "Coin Sorter/Counter" Model 1205 (Publication Date before Jan. 11, 1995) 1 page.

(List continued on next page.)

*Primary Examiner*—F. J. Bartuska

*Attorney, Agent, or Firm*—Arnold White & Durkee

[57] ABSTRACT

A coin sorter for sorting coins of mixed diameters is set forth. The sorter includes a coin-driving member and a coin-guiding member. The lower surface of the coin-guiding member forms a plurality of exit channels for guiding coins of different diameters to different exit stations along the periphery of the coin-guiding member. The coin sorter includes a brake mechanism which permits stopping of the coin-driving member at high speeds such that an invalid coin is retained or for ensuring the correct amount of coins is sent to the coin-collecting receptacle. The coin sorter also includes an operator interface panel for easy operator inputs. Operator inputs allow the operator to adjust the movement of the coin-driving member after encountering a stop and for adjusting the amount of lubrication sent to the coin-guiding member.

27 Claims, 26 Drawing Sheets

U.S. PATENT DOCUMENTS

| | | | |
|---|---|---|---|
| 4,359,062 | 11/1982 | Uecker et al. . | |
| 4,383,540 | 5/1983 | De Meyer et al. . | |
| 4,407,312 | 10/1983 | Davila et al. | 453/32 |
| 4,416,299 | 11/1983 | Bergman . | |
| 4,444,212 | 4/1984 | Ristvedt et al. | 453/10 |
| 4,462,513 | 7/1984 | Dean et al. . | |
| 4,474,281 | 10/1984 | Ronerts et al. | 194/334 |
| 4,483,431 | 11/1984 | Pratt . | |
| 4,538,719 | 9/1985 | Gray et al. . | |
| 4,564,036 | 1/1986 | Ristvedt | 453/10 |
| 4,570,655 | 2/1986 | Raterman . | |
| 4,579,217 | 4/1986 | Rawicz-Szcerbo | 194/317 |
| 4,586,522 | 5/1986 | Taipale et al. . | |
| 4,607,649 | 8/1986 | Taipale et al. | 453/6 |
| 4,620,559 | 11/1986 | Childers | 194/346 X |
| 4,667,093 | 5/1987 | MacDonald | 250/223 |
| 4,681,128 | 7/1987 | Ristvedt et al. | 453/6 |
| 4,681,204 | 7/1987 | Zimmerman | 194/317 |
| 4,696,385 | 9/1987 | Davies | 194/319 |
| 4,715,223 | 12/1987 | Kaiser et al. | 73/163 |
| 4,731,043 | 3/1988 | Ristvedt et al. | 453/6 |
| 4,746,319 | 5/1988 | Zwieg et al. | 453/32 |
| 4,753,624 | 6/1988 | Adams et al. | 453/10 |
| 4,753,625 | 6/1988 | Okada | 453/32 |
| 4,775,354 | 10/1988 | Rasmussen | 453/10 |
| 4,850,469 | 7/1989 | Hayashi et al. | 194/318 |
| 4,863,414 | 9/1989 | Ristvedt et al. | 453/6 |
| 4,864,320 | 9/1989 | Munson et al. | 343/833 |
| 4,881,918 | 11/1989 | Goh et al. | 453/4 |
| 4,921,463 | 5/1990 | Primdahl | 453/3 |
| 4,963,118 | 10/1990 | Gunn et al. | 453/3 |
| 4,964,495 | 10/1990 | Rasmussen | 194/344 |
| 4,966,570 | 10/1990 | Ristvedt et al. | 453/6 |
| 4,971,187 | 11/1990 | Furuva et al. | 194/318 |
| 4,995,497 | 2/1991 | Kai et al. | 194/318 |
| 5,022,889 | 6/1991 | Ristvedt | 453/6 |
| 5,026,320 | 6/1991 | Rasmussen | 453/6 |
| 5,033,602 | 7/1991 | Saarinen et al. | 194/334 |
| 5,055,086 | 10/1991 | Raterman et al. | 453/10 |
| 5,067,604 | 11/1991 | Metcalf . | |
| 5,090,576 | 2/1992 | Menten | 209/587 |
| 5,106,338 | 4/1992 | Rasmussen | 453/10 |
| 5,123,873 | 6/1992 | Rasmussen | 453/10 |
| 5,141,443 | 8/1992 | Rasmussen et al. | 453/10 |
| 5,145,455 | 9/1992 | Todd | 453/6 |
| 5,163,866 | 11/1992 | Rasmussen | 453/10 |
| 5,163,867 | 11/1992 | Rasmussen | 453/10 |
| 5,194,037 | 3/1993 | Jones | 453/10 |
| 5,195,626 | 3/1993 | LeHong | 194/317 |
| 5,197,919 | 3/1993 | Geib | 453/10 |
| 5,205,780 | 4/1993 | Rasmussen | 453/10 |
| 5,209,696 | 5/1993 | Rasmussen | 453/10 |
| 5,213,190 | 5/1993 | Furneaux et al. | 194/317 |
| 5,230,653 | 7/1993 | Shinozaki et al. | 453/4 |
| 5,277,651 | 1/1994 | Rasmussen | 453/10 |
| 5,286,226 | 2/1994 | Rasmussen | 453/10 |
| 5,297,598 | 3/1994 | Rasmussen | 141/314 |
| 5,299,977 | 4/1994 | Mazur et al. | 453/10 |
| 5,372,542 | 12/1994 | Geib | 453/10 |
| 5,401,211 | 3/1995 | Geib | 453/10 |
| 5,425,669 | 6/1995 | Geib | 453/10 |
| 5,429,550 | 7/1995 | Mazur | 453/10 |
| 5,429,551 | 7/1995 | Uecker et al. | 453/18 |
| 5,443,419 | 8/1995 | Adams et al. | 453/17 |
| 5,453,047 | 9/1995 | Mazur | 453/10 |
| 5,468,182 | 11/1995 | Geib | 453/10 |
| 5,480,348 | 1/1996 | Mazur | 453/10 |
| 5,501,632 | 3/1996 | Adams et al. | 453/3 |
| 5,525,104 | 6/1996 | Adams et al. | 453/10 |
| 5,542,880 | 8/1996 | Geib et al. | 453/10 |

FOREIGN PATENT DOCUMENTS

| | | | |
|---|---|---|---|
| 650871 | 12/1982 | Switzerland . | |
| 2128795 | 10/1982 | United Kingdom . | |
| 2117953 | 10/1983 | United Kingdom . | |
| 2146472 | 8/1984 | United Kingdom . | |
| 2147443 | 5/1985 | United Kingdom | 453/57 |
| WO 91/18371 | 11/1991 | WIPO . | |
| WO 95/23387 A1 | 8/1995 | WIPO . | |

OTHER PUBLICATIONS

Brandt "Coin Sorter/Counter" Model 1400 (Publication Date before Jan. 11, 1995) 1 page.

Brandt "Coin Sorter/Counter" Model 952 (Publication Date before Jan. 11, 1995) 1 page.

Brandt "Coin Sorter/Counter" Model 954 (Publication Date before Jan. 11, 1995) 1 page.

Brandt "Coin Sorter/Counter" Model 957 (Publication Date before Jan. 11, 1995) 1 page.

Brandt "Coin Sorter/Counter" Model 958 (Publication Date before Jan. 11, 1995) 3 pages.

Brandt "High–Speed Coin Sorter and Counter" Model 960 (Publication Date before Jan. 11, 1995) 1 page.

Brandt "High Speed Sorter/Counter" Model 940–6 (Publication Date before Jan. 11, 1995) 1 page.

Brandt "High–Speed Sorter" Model 945 (Publication Date before Jan. 11, 1995) 1 page.

Brandt "Microsort Coin Sorter and Counter" Model 966 (Publication Date before Jan. 11, 1995) 2 pages.

Brandt Model 920/925 (Publication Date before Jan. 11, 1995) 1 page.

CA–750 Jetsort Coin Processor (Publication Date before Jan. 11, 1995) 1 page.

Childers, "Computerized Sorter/Counter" (Publication Date before Jan. 11, 1995). 2 pages.

Cummins–Allison's "Jetsort", (Publication Date before Jan. 11, 1995) 1 page.

Cummins–Allison "Jetsort" 3000 Series Options, Bag Adaptors, (Publication Date before Jan. 11, 1995) 1 page.

IBM "Multilevel Character Recognition System" (Publication Date before Jan. 11, 1995) 2 Pages.

"Pulsar" AI–1500, (Publication Date before Jan. 11, 1995) 7 pages.

62
96
92
93
100
49a
49
98
103
94
90
88
84
119
105
104
86
80
129b
48a
106
62
82
129a
48
108
76
102
78
128b
107
72
118
110
69a
128a
98
64
71
121a
121b
74
47a
111
69
127b
112a
70
68
120
122b
66
47
41
41a
61
117
127a
116
124a
124b
126b
46a
112
125b
62
42
42a
126a
113a
123b
46
113
114
45a
43a
44a
125a
115
43
45
44

Fig. 17A

SETUP MAIN MENU

* ENABLE KEYS
* ENABLE FUNCTIONS
* DATA ENTRY SELECTIONS
* PORT SETUP
* DISCRIMINATOR LEARN

HELP
MORE
EXIT

Fig. 17B

SETUP MAIN MENU

* USER DEFAULTS
* BOX/BAG CONFIGURATIONS
* REPOSITION KEYS
* KEY LEGENDS
* LUBRICATION

HELP
BACK
EXIT

Fig. 18A

SELECT DIAGNOSTIC TEST:

* MEMORY INFORMATION
* ENCODER & COIN SENSORS
* KEYBOARD
* MOTOR
* COIN THRUPUT

HELP
MORE
EXIT

Fig. 18B

SELECT DIAGNOSTIC TEST:

* COIN STOP
* BRAKE CYCLE
* COMM PORTS
* REMOTE DISPLAY
* MACHINE STATISTICS

HELP
BACK
EXIT

COIN SORTER

This application is a division of application Ser. No. 08/587,849, filed Jan. 11, 1996 now U.S. Pat. No. 5,865,673.

BACKGROUND OF THE INVENTION

1. Field of the Invention

The present invention relates generally to coin sorting devices and, more particularly, to coin sorters of the type which use a coin-driving member and a coin-guiding member for sorting coins of mixed diameters.

2. Background Information

Although coin sorters have been used for a number or years, problems are still encountered in this technology. For example, friction of the moving coins on the surface of the coin-guiding member can cause galling of that surface. If softer metals are used in coins, some of the softer metal may fuse into the surface of the coin-guiding member. It would be advantageous to have a coin sorter which could not only apply lubrication to the coin-guiding member, but vary the amount of lubrication and the frequency of lubrication by simple operator inputs.

To accomplish exact bag stopping or the expulsion of an invalid coin, the moving components of the system must be decelerated at high rates to ensure that the trigger coin (the invalid coin, or the last coin to be placed in a bag) enters the correct chute. This requires an extreme brake force to be exerted on some of the moving components in the coin sorter when coins are being sorted and discharged at the rate of over 4000 coins per minute. This excessive brake force leads to substantial wear on the brake components. Thus, it would be useful to have an apparatus which continuously adjusts the braking mechanism at an optimum deceleration rate, that is not too excessive, so as to conserve the amount of wear on the brake components.

Furthermore, stopping is often necessary to ensure that only the trigger coin enters the bag. It would be useful to have a bag switching mechanism which would only require the coin sorter to decelerate, and not stop. Thus, the rate of sorting and discriminating would increase if only deceleration were needed. And, the wear on the braking components would decrease. This problem is accentuated when the sensors detecting the coin are in the exit channels near the periphery of the sorting head.

Because the exact bag stop feature may encounter problems in that the trigger coin may not fully discharge from the sorting head due to deviations in the braking mechanism or drive motor, it would be useful to have a feature which allowed the operator to change the amount of angular displacement of the coin-driving member after the trigger coin is detected. Such a feature would provide a user with simplistic means to correct this problem without having to modify the braking mechanism or the coin-driving member. It would also be beneficial to have a coin collection system which would allow the coin sorter to continue operation even though the coin limit for one denomination is reached.

SUMMARY OF THE INVENTION

It is a primary object of this invention to provide an improved coin sorter which can be operated at extremely high speeds and with a high degree of accuracy.

In accordance with the present invention, the foregoing objective is realized by providing a coin sorter which includes a rotatable disc having a resilient top surface and a stationary sorting head having a lower surface positioned parallel to the upper surface of the disc and spaced slightly therefrom. The coin sorter also includes an operator interface panel and a controller for operating the coin sorter.

The operator interface panel allows the operator to adjust the amount of lubrication by modifying the frequency and lubrication pulsing duration at which the lubrication is discharged. Consequently, every coin sorter discharges the lubrication at a rate which is desirable for that specific coin sorter.

Further, the operator, via the operator interface panel, can adjust the amount of disc rotation which occurs after a trigger coin is sensed on the disc to ensure that the trigger coin is completely discharged from the disc, and that the coin following the trigger coin remains on the disc.

Another benefit of the coin sorter described herein is that the operator has the ability to quickly initialize and store in the memory of the controller the characteristic pattern against which the coins of a particular denomination are compared for determining coin validity.

The coin sorter also utilizes an internal brake adjust feature which permits the coin driving member to stop accurately, but without over using the braking mechanism. Thus, the service life of the brake mechanism is increased.

Additionally, the coin sorter includes a dual path bag clamping mechanism having a guiding mechanism that switches the flow of coins between the two bags. The bag clamping mechanism also has a single path version as well. In either bag clamping mechanism, a novel bag interlock mechanism ensures that a bag is properly secured before the coin sorter discharges coins into the bag clamping mechanism.

Also, the guiding mechanism of the bag clamping mechanism that switches the flow of coins between the two bags is positioned far enough along the path of the coin beyond the periphery of the disc that the disc only needs to be decelerated, and not stopped, to perform an exact bag stop.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which:

FIGS. 17A and 17B are illustrations of the touch screen device showing the options available to the operator in the set-up mode;

FIGS. 18A and 18B are illustrations of the touch screen device showing the options available to the operator in the diagnostic mode;

FIG. 28B is an alternative embodiment of FIG. 28A in which the sensors are located outboard of the periphery of the disc, but within the sorting head.

DESCRIPTION OF THE PREFERRED EMBODIMENTS

Figure 1:
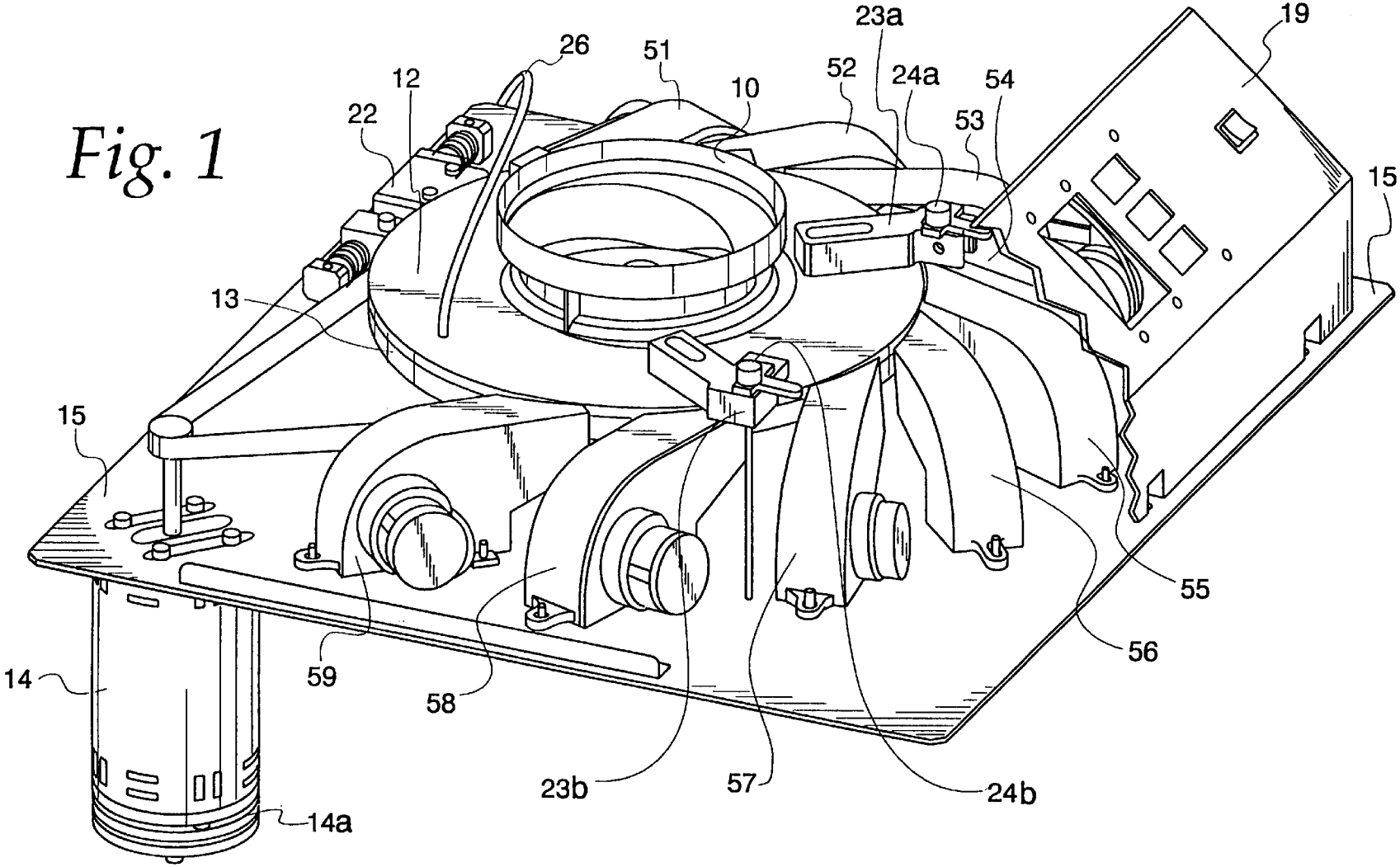
FIG. 1 is perspective view of a coin sorter embodying the present invention, with portions of the front panel broken away to show internal structure.
Figure 2A:
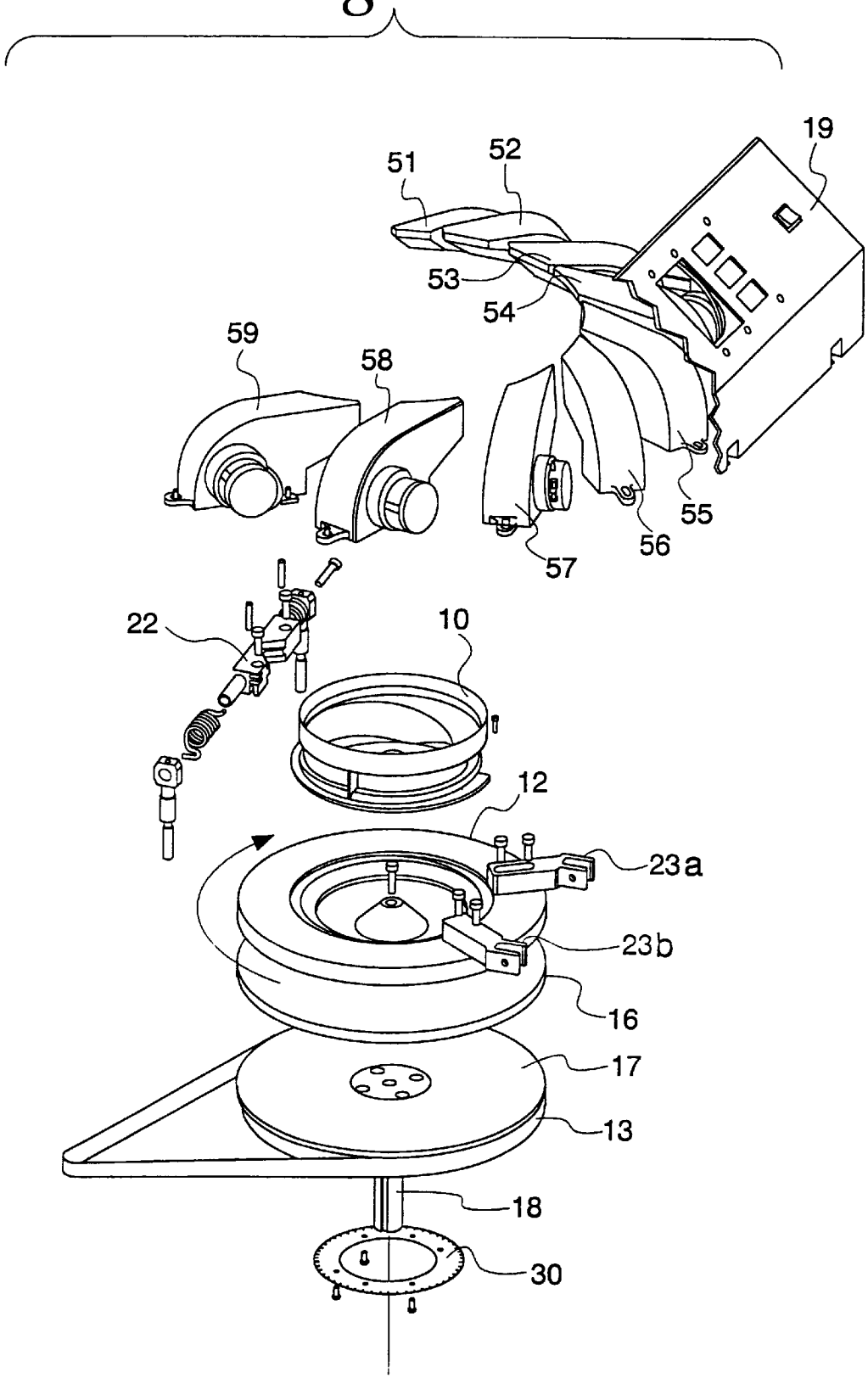
FIGS. 2A and 2B are exploded perspective views of the components of the coin sorter of FIG. 1.
Figure 2B:
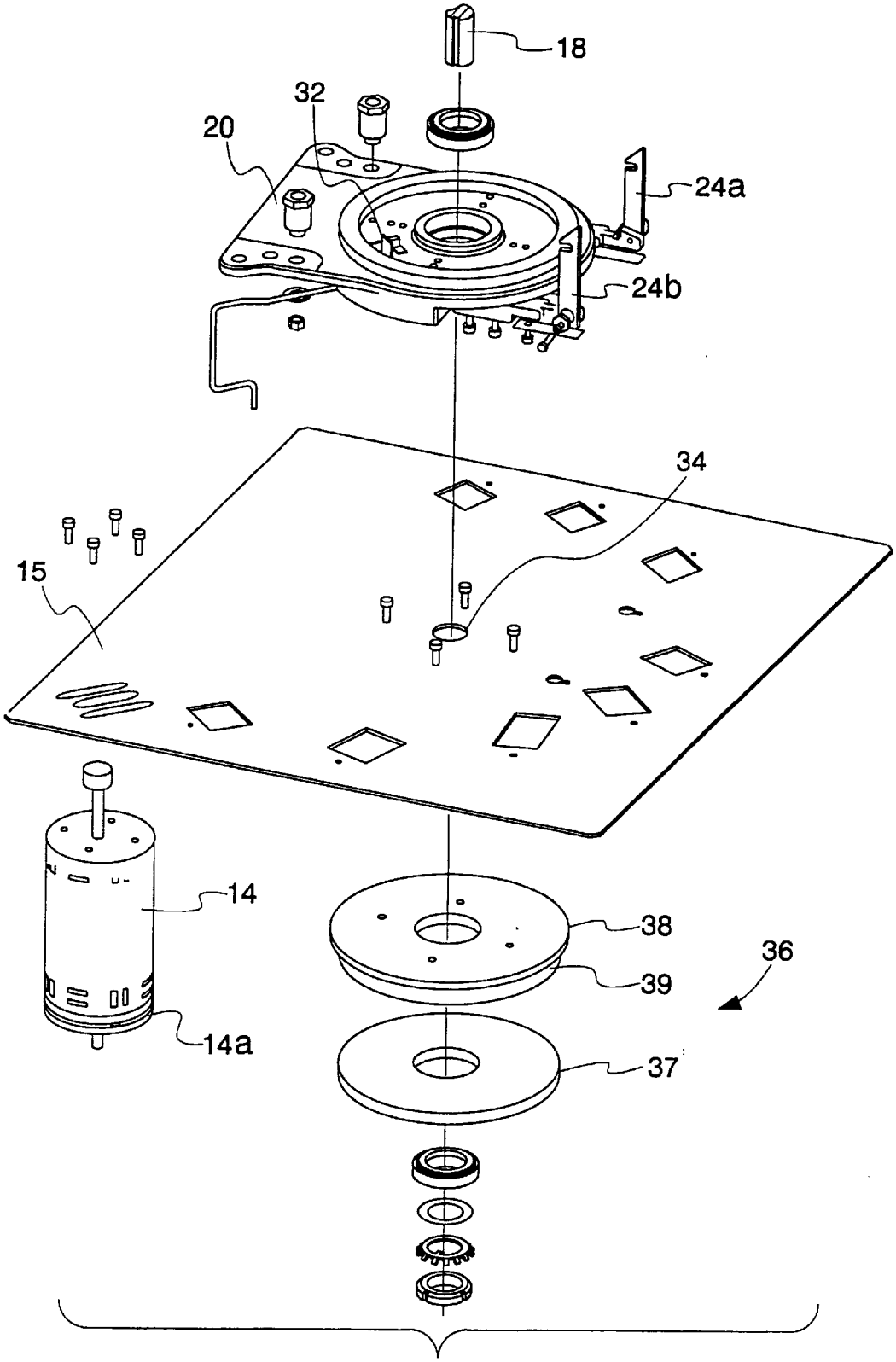

Turning now to the drawings and referring first to FIGS. 1 and 2A–2B, a hopper 10 receives coins of mixed denominations and feeds them through a central feed aperture or opening in an annular sorting head or guide plate 12. As the coins pass through the central opening, they are deposited on the top surface of a rotatable disc 13. This disc 13 is driven by an electric AC or DC motor 14 attached to a platform 15. The motor 14 has a brake mechanism 14a attached to a lower portion of the motor shaft extending through the bottom of the motor 14. The rotatable disc 13 comprises a resilient pad 16 (FIG. 2A), preferably made of a resilient rubber or polymeric material, bonded to the top surface of a solid metal disc 17 (FIG. 2A). The rotatable disc 13 is mounted for rotation on a shaft 18 (FIG. 2A) which is coupled to the motor 14.

FIG. 1 also shows an operator control panel 19 which the operator employs to activate the coin sorter. The control panel 19 is attached to the platform 15. The details of the control panel 19, which includes a touch screen device, are described with reference to FIGS. 14–15.

The sorting head 12 is attached to a mounting structure 20 (FIG. 2B) by a hinge 22. The hinge 22 allows the sorting head 12 to pivot 180 degrees after the operator releases a pair of latches 23*a* and 23*b*. The latches 23*a* and 23*b* capture posts 24*a* and 24*b* which are connected to mounting structure 20. Thus, the position of the sorting head 12 relative to mounting structure 20 is precisely maintained due to the cooperation of the hinge 20 and the latches 23*a* and 23*b*.

A lubrication supply line 26 (FIG. 1) provides lubrication to the sorting head 12 to minimize the friction on the sorting head 12 due to metal-to-metal contact with the coins. The lubrication supply line 26 is attached at one end to a lubrication port (shown in FIGS. 3 and 4) within the sorting head 12, and a lubrication reservoir (not shown) at the other end. The lubrication system is described in detail below with reference to FIGS. 16 and 19.

An encoder 30 (FIG. 2A) is mounted for rotation on the underside of the disc 13. The rotation of the encoder 30 is monitored by an encoder sensor 32 (FIG. 2B) which remains stationary since it is fixed in the mounting structure 20. Therefore, the position of the rotatable disc 13 can be continuously monitored. Because the monitoring of the position of the disc 13 is an important aspect of the coin sorter since it is used in conjunction with other features of the coin sorter, the encoder 30 is discussed in further detail with reference to FIGS. 16–27.

The mounting structure 20 is connected to the platform 15. Further, the shaft 18 extends through hole 34 in the platform 15 and encounters a brake mechanism 36 (FIG. 2B) The brake mechanism includes a brake drum 37 (FIG. 2B) attached to the rotating shaft 18. A brake shoe 38 (FIG. 2B) is attached to the mounting plate 15. The brake shoe 38 includes a brake lining 39 (FIG. 2B) which engages the brake drum 37 as the brake drum 37 rotates thereby reducing the speed of the rotating disc 13. The brake mechanism 14*a* (FIGS. 1 and 2B) of the motor 14 is typically connected in series with the braking mechanism 36 on shaft 18. The braking mechanisms 36 and 14*a* are described in further detail with reference to FIGS. 22 and 24–26.

As the disc 13 is rotated, the coins deposited on the top surface thereof tend to slide outwardly over the surface of the pad 16 due to centrifugal and frictional forces. As the coins move outwardly, those coins which are lying flat on the pad 16 enter the gap between the upper surface of the pad 16 and the sorting head 12 because the underside of the inner periphery of the sorting head 12 is spaced above the pad 16 by a distance which is approximately as great as the thickness of the thickest coin. As further described below, the coins are sorted into their respective denominations and discharged from exit channels 41, 42, 43, 44, 45, 46, 47, 48, and 49 (FIGS. 3 and 4) corresponding to their denominations.

Nine coin chutes 51, 52, 53, 54, 55, 56, 57, 58, and 59 (FIGS. 1 and 2B) are spaced around the periphery of the sorting head 12 adjacent the respective exit channels 41–49. Each coin chute 51–59 is affixed to the platform 15 which includes a coin exit hole corresponding to each of the coin chutes 51–59. As a coin exits a particular exit channel 41–49, it then enters the corresponding coin chute 51–59. If sensors indicate that the coin is invalid, the coin will be diverted by a moveable diverter within the coin chutes 51–59. The coin chutes 51–59 are described in more detail with reference to FIGS. 10A–10D.

In general, the coins for any given currency are sorted by the variation in diameter of the various denominations. The coins circulate between the sorting head 12 and pad 16 on the rotatable disc 13 until a single-file stream of coins is obtained. One edge of each coin in this stream of coins is aligned along a gaging surface so that the other edge of each coin is subsequently positioned so as to be directed into the exit channels 41–49 for the respective denominations.

Figure 3:
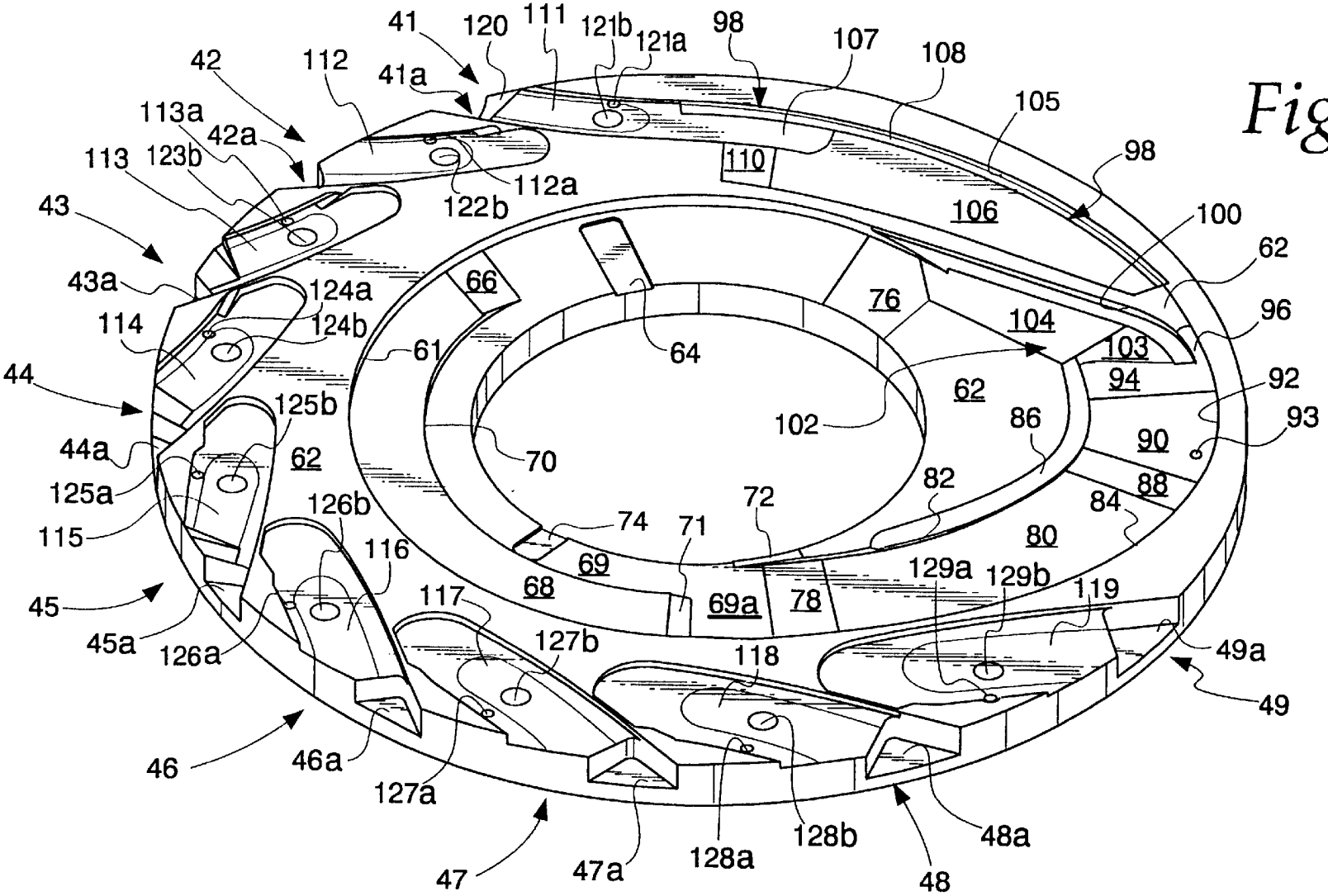
FIG. 3 is a perspective view of the bottom of the sorting head or guide plate of FIG. 1.
Figures 4, 9:
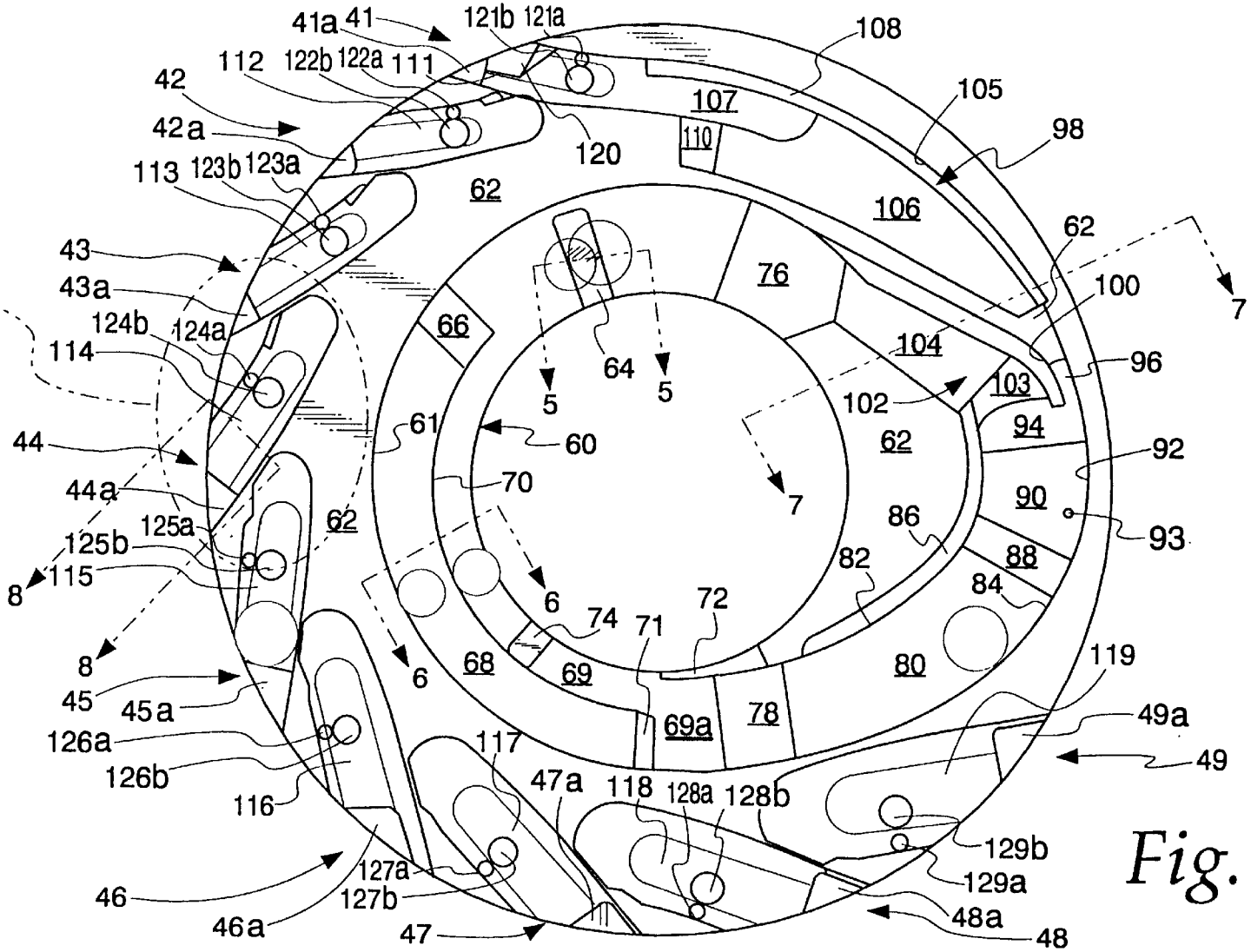
FIG. 4 is a bottom plan view of the sorting head or guide plate in the coin sorter of FIG. 1.
FIG. 9 is a enlarged view of one of the exit channels in the sorting head of FIGS. 3 and 4.
Figure 6:
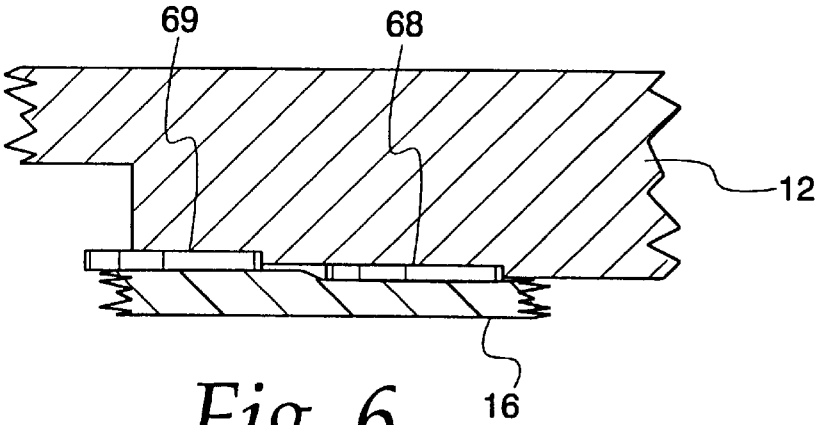
FIG. 6 is a cross-sectional view of the entry channel region of the sorting head taken along line 6—6 in FIG. 4.

As can be seen in FIGS. 3 and 4, the outwardly moving coins initially enter an entry channel 60 formed in the underside of the sorting head 12 from the central opening that is seen when looking into the hopper 10. It should be kept in mind that the circulation of the coins, which is clockwise in FIG. 2, appears counter-clockwise in FIGS. 3 and 4 because FIGS. 3 and 4 are bottom views. An outer wall 61 of the entry channel 60 extends between the entry channel 60 and the lowermost surface 62 of the sorting head 12. The lowermost surface 62 is preferably spaced from the top surface of the pad 16 by a distance which is slightly less than the thickness of the thinnest coins. Consequently, the initial outward movement of the coins is terminated when they engage the wall 61 of the entry channel 60, although the coins continue to move circumferentially along the wall 61 by the rotational movement imparted on them by rotating pad 16.

A stripping notch 64 is present to strip "shingled" or "doubled" coins (i.e. coins which are stacked on one another) The stripping notch 64 causes the upper coin to catch on its ledge while the lower coin proceeds with the rotation of the pad 16. The stripping notch 64 extends in an upward direction since the lower surface of the sorting head 12 is adjacent the pad 16 on the upper surface of the disc 13.

Figure 5A:
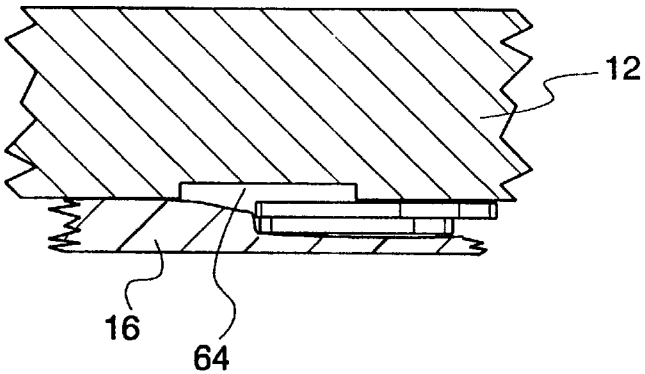
FIG. 5A is a cross-sectional view of a stripping channel in the sorting head taken along line 5—5 in FIG. 4 before two stacked coins are stripped.
Figure 5B:
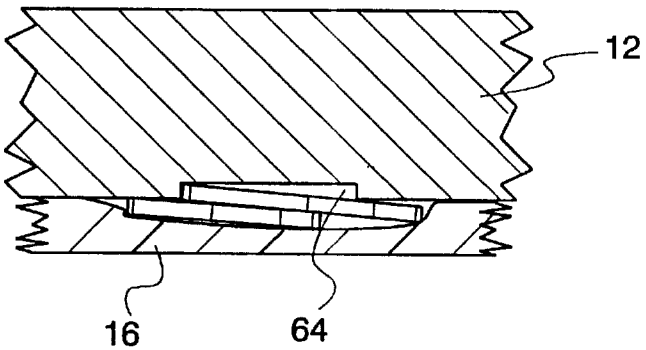
FIG. 5B is a cross-sectional view of a stripping channel in the sorting head taken along line 5—5 in FIG. 4 after two stacked coins are stripped.
Figure 9:
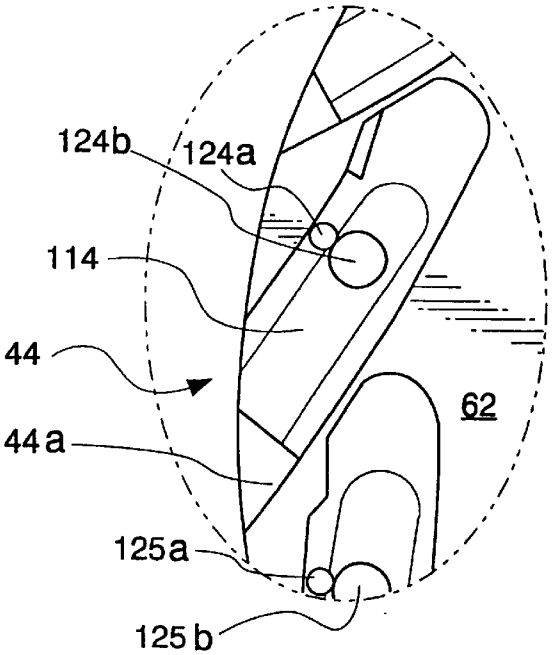

FIGS. 5A and 5B are sectional views taken along line 5—5 in FIG. 4 in the region of the stripping notch 64 of the sorting head 12. In FIG. 5A, the coins are being moved by pad 16 and are about to engage the stripping notch 64. In FIG. 5B, the upper coin engages the stripping notch 64 and catches thereon. The lower coin continues moving with the pad 16. After the lower coin has passed the stripping notch 64, the upper coin, which is now against the pad 16 since the lower coin has moved forward, continues to move forward with the pad 16. In this way, stacked coins are stripped and only single coins move through the entry channel 60. Typically, the stripping notch 64 has a depth that is less than the thickest coin which is to be sorted. Also, the width of the stripping notch 64 is less than the diameter of the smallest coin that is to be sorted. And, although the stripping notch 64 is shown extending almost entirely across the entry channel 60 in the radial direction, it may extend the entire way across the entry channel 60.

As the disc 13 rotates, coins in the entry channel 60 that are close enough to the wall 61 engage a ramp 66 leading to surface 68. Surface 68 is spaced closer to the pad 16 than the surface of the entry channel 61. An upper surface 69 is adjacent the surface 68 and spaced further from the pad 16. Coins which are not against wall 61 but engage the inner edge of ramp 66 are sent along upper surface 69 where they are eventually recycled. A wall 70 defines an inner border for the surface 68 and extends to a ramp 71 leading down to an outermost region 69*a* of surface 69. The wall 70 also tends to strip "shingled" or "doubled" coins passing through the entry channel 60. Preferably, the wall 70 separates the top coin of a pair of "shingled" or "doubled" coins and guides the top coin inwardly for recirculation. A second smaller stripping notch 74 is also present on upper surface 69 which strips any "shingled" or "doubled" coins.

As stated previously, misaligned coins which are not against wall 61 and miss the ramp 66 require recirculation. The misaligned coins engage the wall 70, and the wall 70 guides these coins to a ramp 72 leading down to the lowermost surface 62. As the coins move down the ramp 72, the coins are pressed into the pad 16. Once in a pressed engagement with the pad 16, these coins remain in the same radial position but move circumferentially along the lowermost surface 62 until engaging recirculation ramp 76. The recirculation ramp 76 leads back up into the entry channel 60 and recirculates the misaligned or stripped coins back into the entry channel 60.

Coins on the pad 16 which move past surface 68 are in engagement with surface 68 such that they are pressed into the pad 16. This pad pressure on the coins is referred to as "positive control." Those coins that reach the surface 68 move circumferentially thereon due to this positive control. Those coins on surface 68 pass the ramp 71 and the outermost region 69*a* of surface 69 wherein they are released from the pressure which they experienced while moving along surface 68. These coins move to a ramp 78 which leads to a queuing channel 80.

A guide wall 82 defines the inner border of the queuing channel 80. The guide wall 82 provides another coin stripping mechanism to reduce "shingled" or "doubled" coins. Typically, the guide wall 82 is approximately 0.030 inch in height. As described above for the wall 70, misaligned or stripped coins that engage the upstream portion of the guide wall 82 are guided towards lowermost surface 62 for recirculation.

The coins that reach the queuing channel 80 continue moving circumferentially and radially outward along the channel 80 due to the rotation of the rotating disc 13. The radial movement is due to the fact that almost all coins except for the thickest ones, are not in engagement with queuing channel 80. An outer wall 84 of the queuing channel 80 prohibits the radial movement of the coins beyond the queuing channel 80. The queuing channel 80 cannot be too deep since a deep channel would increase the risk of accumulating "doubled" or "shingled" coins in the queuing channel 80. Consequently, in the queuing channel 80, the thickest coins may be under positive control since they are in pressed engagement with the pad 16. However, the thickest coins still remain within queuing channel 80 since a bevelled surface 86 extends from guide wall 82 in a downward direction to lowermost surface 62 by a distance generally less than the thickness of the thinnest coin. Those thicker coins then are guided along the queuing channel 80 as they engage guide wall 82 and bevelled surface 86.

In the queuing channel 80, if "doubled" or "shingled" coins exist, they are under pad pressure and tend to remain in their radial position. Consequently, as the "doubled" or "shingled" coins move circumferentially and maintain their radial position, the guide wall 82 engages the upper coin of the "shingled" or "doubled" coins, tending to separate the coins. While the guide wall 82 separates the coins, the lower coin engages the beveled surface 86 and, once separated, the lower coin is still under pad pressure with the beveled surface 86. Thus, the lower coin retains its radial position while moving circumferentially with the pad 16 and passes under the beveled surface 86 to the lowermost surface 62 for recirculation. The upper coin remains within queuing channel 80.

Some coin sorters, however, have queuing channels in which the coins are pressed into engagement with the pad 16 such that the pad 16 exerts positive control on the coins. In the queuing channel 80 illustrated in FIGS. 3–4, however, most coins are not under pad pressure and are free to move outwardly due to centrifugal force until the coins engage the outer wall 84 of the queuing channel 80. The thickest coins which are under positive control maintain their radial position while continuing to move circumferentially along the queuing channel due to the rotational movement of the pad 16. These thicker coins engage the guide wall 82 and bevelled surface 62 and are maintained within queuing channel 80.

As the coins move circumferentially along the queuing channel 80, the coins encounter a ramp 88 leading up into a deep channel 90. The deep channel 90 releases positive control on any thick coins that may have been under positive control in the queuing channel 80 and, thereby, unable to move outwardly to engage the wall 84 of the queuing channel 80. Therefore, as these thicker coins enter the deep channel 90, the coins are further permitted to move outwardly and desirably engage an outside wall 92 of the deep channel 90. The outer wall 84 of the queuing channel 80 blends into the outside wall 92 of the deep channel 90. After the coins enter the deep channel 90, the coins are desirably in a single-file stream of coins directed against the outer wall 92 of the deep channel 90.

Within deep channel 90 lies a lubrication port 93 for the sorting head 12. Here, lubrication is discharged typically in extremely low quantities. This is to ensure that no lubrication contacts the pad 16 positioned below the sorting head 12 which could damage the pad 16. The lubrication port 93 is made at such a size that only a droplet of lubrication fluid forms on deep channel 90 and is suspended there by surface tension. As coins pass the droplet, a portion of it adheres to the coins and is transmitted around the remaining coin path along the sorting head 12. Thus, it is the coins which distribute the lubrication around the sorting head 12. The lubrication port 93 can be positioned anywhere along the coin path, although preferably it is in the region of the queuing channel 80 or the deep channel 90. Furthermore, the sorting head can have multiple lubrication ports 93.

The lubrication helps to reduce the friction that occurs due to the metal-to-metal contact between the coins and the lower surface of the sorting head 12. Thus, the lubrication minimizes the wear on the sorting head 12. Furthermore, because the coins of some countries are made of softer metal, the softer metal can be transferred to the sorting head and be deposited thereon due to the friction and heat. Lubrication minimizes this galling condition as well.

The lubrication port 93 is generally between about 0.02 inch and 0.06 inch in diameter with the preferable size being approximately 0.04 inch. At the upper end of the lubrication port 93 opposite the end exposed in the deep channel 90, the lubrication port 93 expands in diameter to allow a fitting to be disposed therein. The supply line 26 (FIG. 1) is coupled to the fitting. Typically, the fitting is made of a polymeric material, such as nylon, with an outer diameter of about 0.25 inch.

Lubrication is supplied to the sorting head 12 via the supply line 26 which is connected to a lubrication reservoir. The reservoir may be positioned above the lubrication port 93 such that lubrication flows to the port 93 via gravity and under the control of a valve. Alternatively, a pump can supply the lubrication fluid to the port 93. An example of a pump which can be employed in the lubrication system is the SR 10-30 peristaltic pump from the ASF Corporation of Norcross, Ga. An exemplary lubrication system for a coin sorter is described in U.S. patent application Ser. No. 08/401,414 filed on Mar. 9, 1995 which is herein incorporated by reference in its entirety.

Returning now to the movement of the coins in the sorting head 12, as the coins move circumferentially along the outer wall 92, the coins engage a slight ramp 94 which leads to and blends in with narrow bridge 96. The narrow bridge 96 leads down to the lowermost surface 62 of the sorting head 12. At the downstream end of the narrow bridge 96, the coins are firmly pressed into the pad 16. As such, the coins are under positive control. Therefore, the radial position of the coins is maintained as the coins move circumferentially towards a gaging channel 98.

If any coin in the stream of coins leading up to the narrow bridge 96 is not sufficiently close to the wall 92 so as to engage the narrow bridge 96, then the misaligned coin engages an outer wall 100 of a reject pocket 102. The reject pocket 102 includes a ramped surface 103 and a beveled surface 104 that is slightly angled (e.g., 5¼ degrees) with respect to the pad 16. The ramped surface 103 and beveled surface 104 are angled such that their outermost portions near outer wall 100 are the deepest portions. As the misaligned coins pass across ramped surface 103 and engage wall 100, they are driven towards beveled surface 104. The beveled surface 104 allows misaligned coins to move away from pressed engagement with the pad 16. When the leading edges of the misaligned coins hit wall 100, the misaligned coins are guided back to the entry channel 60 for recirculation via the beveled surface 104 and the recirculation ramp 76.

To summarize, the coins which do not engage narrow ramp 96 can be generally placed into two groups. First, those coins which did not proceed along surface 68, but instead proceeded along surface 69 and engaged ramp 72 where they were pressed into engagement with the pad 16, entered recirculation ramp 76 near its inner radial edge adjacent lowermost surface 62. And, the second group of coins are those coins that moved past ramped surface 103 into engagement with wall 100 and subsequently moved past bevelled surface 104 where they engaged the recirculation ramp 76 near its outer radial edge adjacent bevelled surface 104.

It can occur that correctly aligned coins passing under the recirculating channel 102 as the coins move circumferentially towards the gaging channel 98 can be slightly shifted in their radial position. To correct this, coins which pass under the recirculating channel 102 still find themselves within the gaging channel 98. The coins remain under pressure in the gaging channel 98, but the gaging channel 98 tends to urge the coins to be realigned against an outer gaging wall 105 of the gaging channel 98 due to a bevelled gaging surface 106 which is angled such that it is deeper at its radially outward portions. Furthermore, the radius of the gaging wall 105 from the center of the disc 13 also gradually decreases along the length of the gaging channel 98 to help maintain coins in engagement with the outer wall 105. Therefore, all coins entering the gaging channel 98 have an opportunity to realign their outer edges at the radial position required for correct sorting.

The beveled surface 106 has a deep channel 108 along its outermost edges. Coins aligned against outer wall 105 are under positive pressure at their innermost edges which are positioned along bevelled surface 106. Due to this positive pressure on the innermost edges, the outermost edges of the coins tend to rise slightly away from the pad 16. Because the beveled surface 106 applies a greater amount of pressure on the inside edges of the coins, the beveled surface 106 helps to prevent the coins from bouncing off the wall 105 as the radial position of the coins is gradually decreased along the length of the gaging channel 98.

As the coins move along the gaging wall 105, they move past a narrow channel 107 which is dedicated to the smallest coin to be sorted. All coins of this denomination fit within the narrow channel 107 as they engage gaging wall 105. Preferably, the narrow channel 107 extends well into the bevelled surface 106. Every other coin denomination is too large to fit within the first narrow channel 107. Consequently, these other denominations have their outer edges along outer wall 105 and their inner edges on bevelled surface 106.

Figure 7:
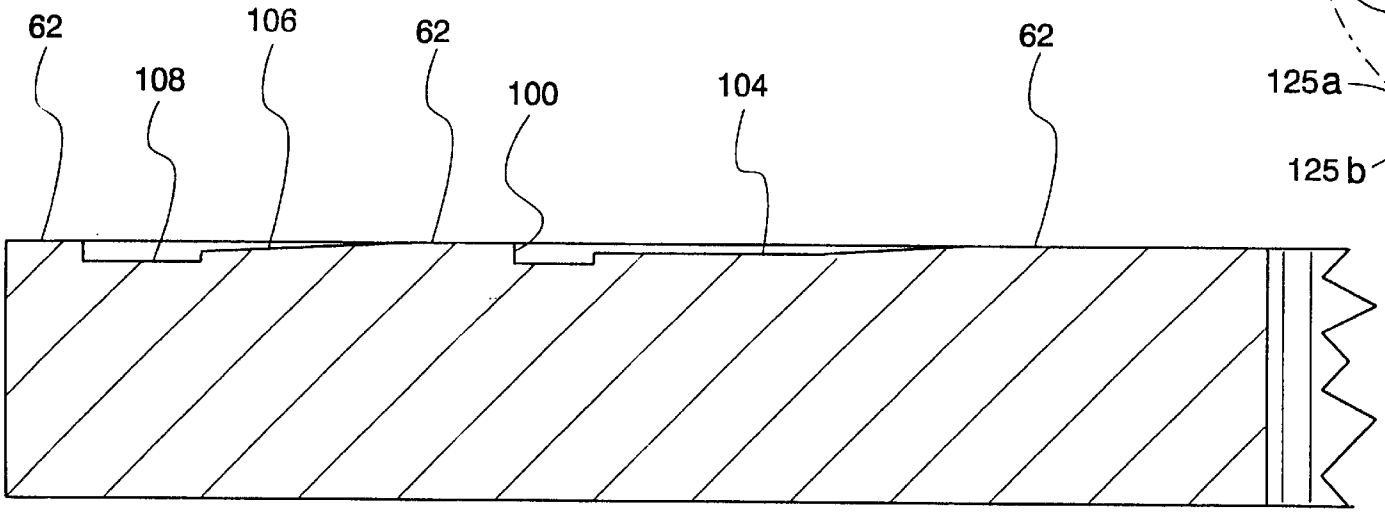
FIG. 7 is a cross-sectional view of the sorting head taken along line 7—7 in FIG. 4.

FIG. 7 illustrates a cross-section of the sorting head 12 along line 7—7 in FIG. 4. The wall 100 and the beveled surface 104 within the reject pocket 102 can be seen on the right side of FIG. 7. Also, the beveled surface 106 and the deep channel 108 of the gaging channel 98 can be seen as well.

As the coins move along the gaging wall 105 of the gaging channel 98, the coins other than the smallest coins which are in narrow channel 107 engage a ramp 110 leading down to the lowermost surface 62. The ramp 110 causes the coins to be firmly pressed into the pad 16 with their outermost edges aligned with the gaging radius provided by the gaging wall 105. At the downstream end of the ramp 110, the coins are under the positive control of the sorting head 12. This ensures that the coins are held securely in the proper radial position determined by the gaging wall 105 as the coins approach the series of exit channels 42–49.

The first exit channel 41, which is dedicated to the smallest coin to be sorted, merges with narrow channel 107. thus, the smallest coins do not engage the lowermost surface 62 once they are within the gaging channel 98. Coins other than the smallest coins move in a circumferential direction along lowermost surface 62 under positive pressure towards their respective exit slots 42–49.

Beyond the first exit channel 41, the sorting head 12 forms the series of exit channels 42–49 which function as selecting means to discharge coins of different denominations at different circumferential locations around the periphery of the sorting head 12. Thus, the exit channels 42–49 are spaced circumferentially around the outer periphery of the sorting head 12, with the innermost edges of successive channels located progressively closer to the center of the sorting head 12 so that coins are discharged in the order of increasing diameter.

In the particular embodiment illustrated, the nine exit channels 41–49 are positioned to eject successively larger coins. This configuration is useful in foreign countries which have nine coins such as Spain or France. Clearly, the sorting head 12 could also be configured to have only six exit channels by eliminating three channels such that the U.S. coin set (dimes, pennies, nickels, quarters, half dollars, and dollar coins) can be sorted. This can also be accomplished by using the sorting head 12 illustrated in FIGS. 3 and 4 with a blocking element placed in three of the exit channels 41–49.

The innermost edges of the exit channels 41–49 are positioned so that the inner edge of a coin of only one particular denomination can enter each channel. The coins of all other denominations reaching a given exit channel extend inwardly beyond the innermost edge of that particular channel so that those coins cannot enter the channel and, therefore, continue on to the next exit channel under the circumferential movement imparted on them by the pad 16.

To ensure that positive control over the coins is maintained within the exit channels 41–49, the pad 16 preferably continues to exert pressure on the coins as they move through the exit channels 41–49. However, this can be problematic if a particular coin is thin, such as a dime. To overcome this problem, a pressure ramp 120 is included in exit channel 41. The pressure ramp 120 ensures that the coins within exit channel 41 near the periphery of the sorting head 12 engage pad 16. Thus, when the deceleration and/or stopping of the disc 13 is encountered during the exact bag stop function or the discrimination of valid/invalid coins function, a coin within the exit channel 41 is positively controlled by the pad 16 on the disc 13. Furthermore, because this pressure ramp 120 is near the counting sensor 121*a* and the discriminator sensor 121*b*, the pressure ramp 120 also tends to maintain coin stability while the coin is being sensed. Although the pressure ramp 120 is shown only in exit channel 41, it can also be used in the other exit channels 42–49 as well. Additionally, the pressure ramp 120 may be longer and extend along the length of its respective exit channel 42–49.

Each exit channel 41–49 has a corresponding exit channel opening at which the coins exit from the periphery of the sorting head 12. Each exit channel 41–49 also has a corresponding exit ledge 41*a*–49*a*. The exit ledges 41*a*–49*a* are positioned to ensure that a coin that is to exit the periphery of the disc 13 does, in fact, exit if the disc 13 stops after such a coin is sensed. If the exit ledges 41*a*–49*a* were not present, then the innermost edge of an exiting coin may become pinched at the periphery of the sorting head 12 such that the coin is entirely outside the periphery of the sorting head 12 except for its innermost edge. Each exit ledge 41*a*–49*a* is generally perpendicular to the path of the coins within its respective exit channel 41–49. Also, each exit ledge 41*a*–49*a* has a corner that terminates on the periphery of the sorting head 12 near the center line of its respective exit channel 41–49 within the slot described below.

Each of the exit channels 41–49 also has a slot 111–119 which provides additional clearance for the central portion of the coin within the exit channels 41–49. Any deviations in the central thickness of the coin due to curvature or coin features which make the center of the coin thicker than its periphery, can now extend into the slots 111–119 such that the coin rides along the portions of the exit channels 41–49 outside of the slots 111–119. In essence, the coins ride only on the two rails formed on either side of the slots 111–119.

As the coins pass across counting sensors 121*a*–129*a* and discriminator sensors 121*b*–129*b* located in the exit channels 41–49, the coins are much less prone to the teetering motion due to the slots 111–119. The counting sensors 121*a*–129*a* count the coins. The discriminator sensors 121*b*–129*b* discriminate between a valid coin and a invalid coin. Due to the slots 111–119 and the positive control due to pad pressure, the counting sensors 121*a*–129*a* and the discriminator sensors 121*b*–129*b* sense a coin which is being guided smoothly and is experiencing no teetering. This enhances the accuracy of the counting sensors 121*a*–129*a* and the discriminator sensors 121*b*–129*b*.

Figure 8:
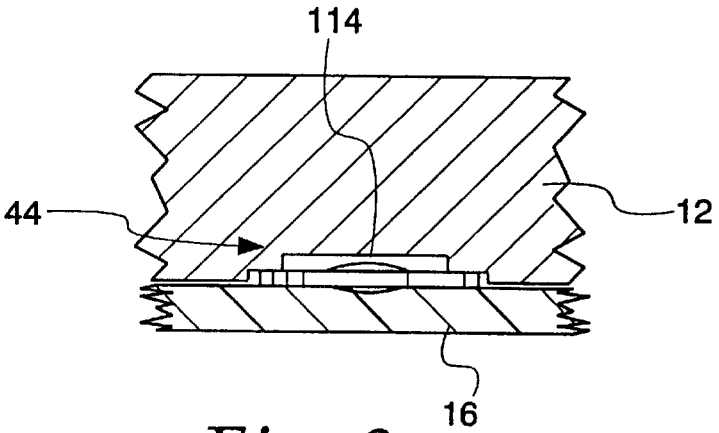
FIG. 8 is a cross-sectional view of an exit channel of the sorting head taken along line 8—8 in FIG. 4.

The slots 111–119 are shown in more detail in FIG. 8 which shows a cross-section taken along line 8—8 in FIG. 4 in exit channel 44. FIG. 8 illustrates a slot 114 which has a width approximately one half of the diameter of coin. Clearly, the width of the slot 114 may be much larger such that it is up to 90% of the diameter of coin. The slot 114 has a rectangular cross-section which accommodates a protruding portion of the coin as the coin is guided along the exit channel 44. Other shapes of the slot 114, such as rounded or triangular, are available as well.

FIG. 9 illustrates an enlarged view of exit channel 44 showing the details of the exit channel 44. The location of the sensors 124*a* and 124*b* are shown as is the exit ledge 44*a*. As can be seen, the slot 114 begins within the exit channel 44 upstream of the sensors 124*a* and 124*b*.

Figure 10D:
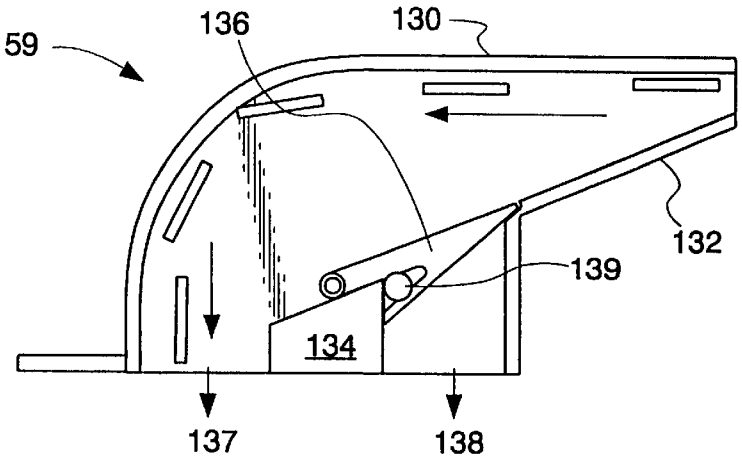
FIGS. 10A–10D are cross-sectional views of the exit chute and the discriminator shunting mechanism shown in FIG. 1.
Figure 10A:
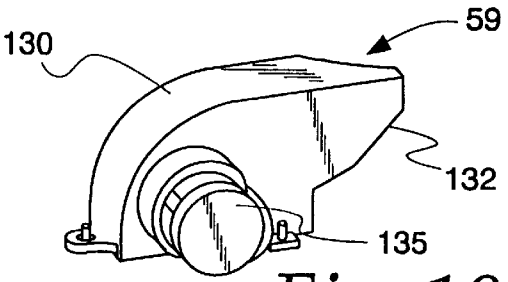
Figure 10C:
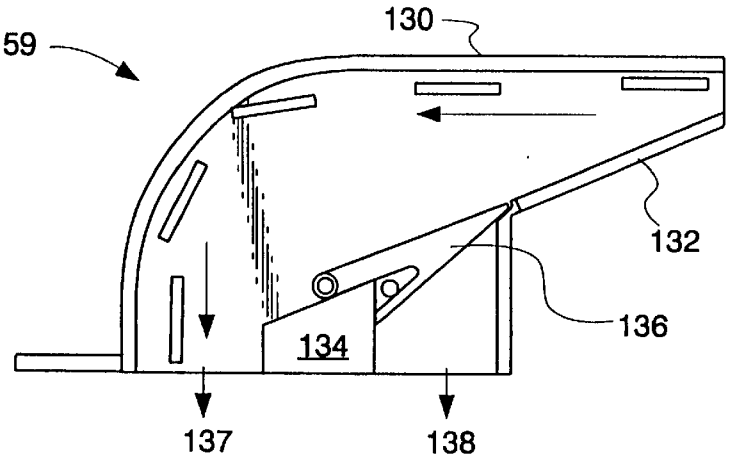
Figure 10B:
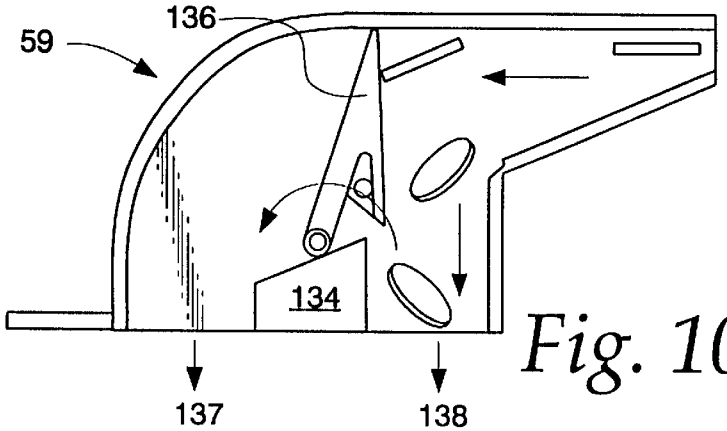

Now that the sorting head 12 of the coin sorter has been described, the path of the sorted coins as they exit the periphery of the sorting head 12 is described below. FIGS. 10A–10C illustrate one coin chute 59 of the nine coin chutes 51–59 shown in FIGS. 1 and 2A. The coin chute 59 has an upper curved wall 130 and a lower wall 132. The lower wall 132 is angled downwardly so that a coin with a low velocity still moves toward the two chutes under the force of gravity. A dividing structure 134 to which a flipper 136 is attached separates two chutes of the coin chute 59. The flipper 136 acts as a shunting mechanism since it can direct the coins into the two chutes 137 and 138. The flipper 136 is flush with the lower surface 132 when the flipper 136 is in its normal lower position (FIG. 10C) such that a coin sliding down lower surface 132 passes across the flipper 136 without being caught thereon, and is discharged down the first chute 137.

A shunt motor 135 (FIG. 10A) controls the movement of the flipper 136 such that the flipper 136 transitions between an upper orientation shown in FIG. 10B and a lower orientation shown in FIG. 10C. The shunt motor 135 can also be a simple solenoid that toggles an arm connected to the flipper 136 between a first and second displacement position.

As the sorted coins pass the discriminator sensor 129*b* (FIGS. 3–4) in the exit channel 49, the discriminator 129*b* senses whether the coin is a valid or invalid coin. The discriminator sensor 129*b* is connected to a controller which is described in more detail below in reference to FIG. 16. If the signal from the discriminator sensor 129*b* to the controller indicates a valid coin, the flipper 136 remains in the lower position and the coin exits the disc 13 and enters the coin chute 59 where it proceeds down first chute 137 as shown in FIG. 10C.

If the signal from the discriminator sensor 129*b* to the controller indicates an invalid coin in the exit channel 49, the controller then signals the shunt motor 135 to move the flipper 136 from the lower orientation (FIG. 10) to the upper orientation (FIG. 10). As the invalid coin enters the coin chute 59 after passing from the exit channel 49, it encounters the flipper 136 which obstructs its path and forces the invalid coin down second chute 138.

The coin chute 59 is designed so as to be compatible with two types of coin sorters—one which utilizes discriminator sensors 129*b* to detect invalid coins and one which does not detect invalid coins. FIGS. 10A–10C illustrate the coin chute 59 in a first configuration for use with a coin sorter which performs coin discrimination to detect invalid coins. FIG. 10D illustrates the same coin chute 59 in a second configuration except that a pin 139 now maintains the flipper 136 in its lower position. Consequently, the first chute 137 is the only chute into which the coins may pass. The only additional component, pin 139, can be a rivet, a screw, or numerous other fasteners which maintain the flipper 136 in the lower orientation. Further, adhesives can be used as well. Therefore, coin chute 59 is modular such that it can be used on nearly every type of coin sorting device. Because one component is interchangeable with numerous coin sorter devices, the manufacturing and design costs are dramatically reduced.

Figure 11B:
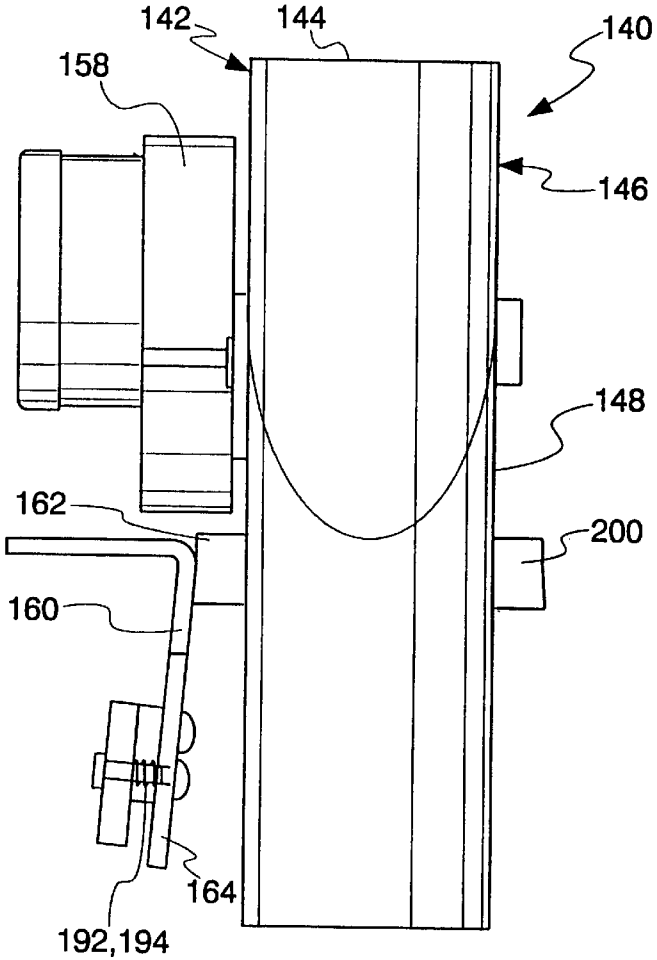
FIGS. 11A–11B are front and side views respectively of a dual path bag changing mechanism.
Figure 11A:
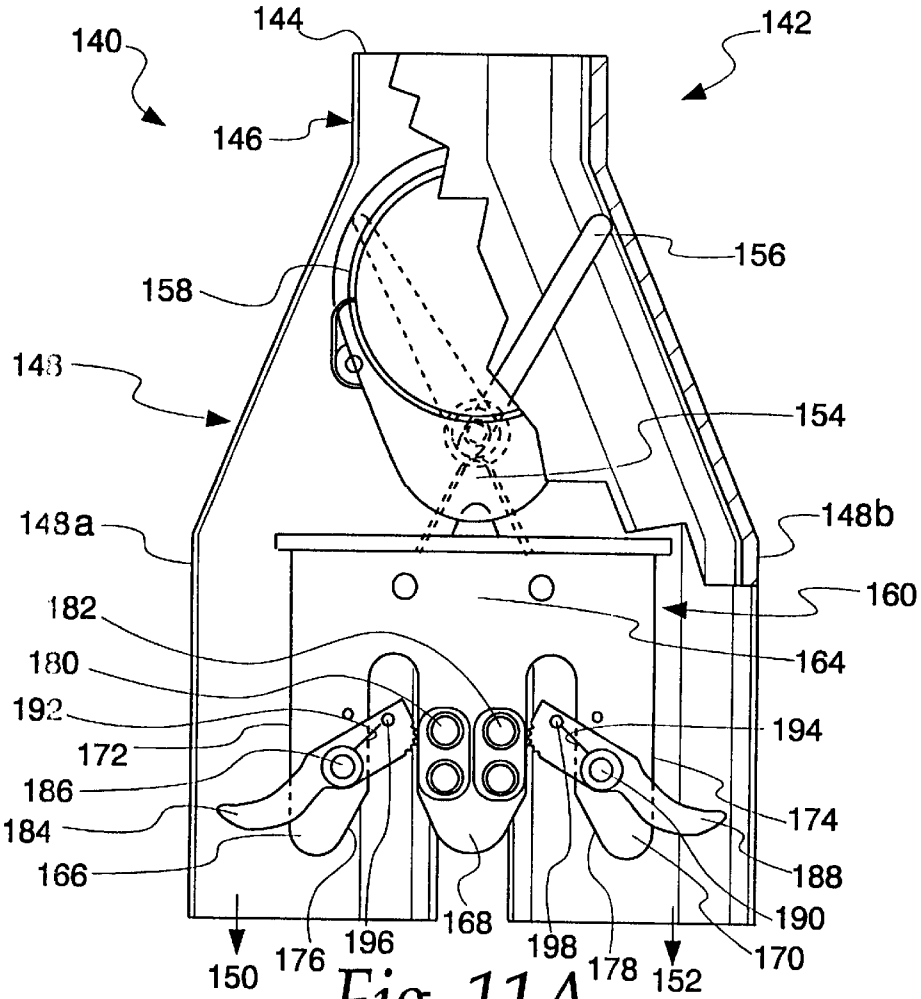

Once the coins have undergone the discrimination process, the coins then enter a coin collector which is usually a bag. FIGS. 11A and 11B illustrate a dual bag clamping and switching mechanism 140 including a guide tube 142 having an inlet edge 144 and a rectangular-shaped upper portion 146. The inlet edge 144 of the guide tube 142 is aligned with the path of the coins. Coins enter the inlet edge 144 and proceed into the upper portion 14G of the guide tube 142.

In passing from the coin sorter to the guide tube 142, coins tend to strike the inner surface thereof- To minimize the wear on the upper portion 146 and reduce the noise caused by such coin impacts, the upper portion 146 is preferably composed of a relatively soft polymeric material such as polyurethane or rubber.

An integral lower portion 148 of the bag switching mechanism 140 splits into two coin chutes 150 and 152 which are separated by divider 154. The divider 154 partitions a left lower portion 148*a* from a right lower portion 148*b*. A flipper 156 is disposed on top of the divider 154 and is positioned such that either chute 150 or chute 152 is open. The position of the flipper 156 is controlled by a bag switch motor 158. The bag switch motor 158 can also be a solenoid which toggles the flipper 156 between the two positions.

As coins are counted by counting sensors 121*a*–129*a* shown in FIGS. 3–4 and a predetermined number of coins is received by the bag below chute 150, a controller actuates the bag switch motor 158 which moves the flipper 156 to divert the coins from chute 150 to chute 152. Once the operator switches the full bag under chute 150 and replaces it with an empty bag, then the flipper 156 may redirect coins into the first bag when the second bag is full.

The lower portion 148 is provided with an electrically insulated frame 160 having a lateral support bracket 162 and a longitudinal three-pronged fork member 164 extending downwardly from the lateral support bracket 162. The lateral support bracket 162 is generally rectangular in shape and is positioned near the divider 164.

The forked member 164 includes first, second and third prongs 166, 168, and 170, respectively. The forked member 164 is oriented perpendicular to the support bracket 162 and substantially parallel to the lower portion 148. The first prong 166 and the third prong 170 are typically spaced equidistant from an imaginary line passing halfway therebetween through the second prong 168. The first and third prongs 166 and 170 are mirror images of each other. Each includes respective straight outer edges 172 and 174. The first and third prong 166 and 170 each include a respective curvilinear inner edge 176 and 178 which gradually curves away from a straight inner edge of the prongs 166 and 170 as one moves downwardly from approximately the middle of the prongs 166 and 170.

Two block-shaped, stationary conductive contacts 180 and 182 are fixedly mounted to the approximate middle of the second prong 168. First contact 180 engages an elongated first conductive lever 184 which is pivotally mounted to the first prong 166 by means of a conductive pivot pin 186. Conductive pin 186 extends through a central portion of the lever 184 and the first prong 166. While the first lever 184 rotates about the stationary pivot pin 186, the lever 184 is maintained on the pivot pin 186 by a retaining ring. Likewise, second contact 182 on the second prong 168 engages an elongated second conductive lever 188 which is pivotally mounted to the third prong 170 by means of a conductive pivot pin 190. Conductive pin 190 extends through a central portion of the second lever 188 and the third prong 170.

Each elongated lever 184 and 188 is laterally spaced away from its respective prong 166 and 170 so that the respective pivot pins 186 and 190 include an uncovered cylindrical section for receiving a torsion spring 192 and 194. The torsion springs 192 and 194 spirals around the uncovered section of their respective pins 186 and 190 for several turns. The ends of each torsion spring 192 and 194 extend through respective holes 196 and 198 in levers 184 and 188.

The torsion springs 192 and 194 exert a torque on the levers 184 and 188 which biases the levers 184 and 188 to a closed position (shown in FIG. 11A). In the closed position, the levers 184 and 188 are preferably constructed such the end of each lever 184 and 188 engages its respective stationary contacts 180 and 182.

When the first lever 184 engages the stationary contact 180, a conductive path is formed therebetween. To disengage the first lever 184 from the contact 180, the lever 184 is rotated counterclockwise about the pivot pin 186 to an open position by depressing the bottom edge of the lever 184. Disengaging the lever 184 from the contact 180 interrupts the conductive path formed therebetween.

Similarly, when the second lever 188 engages the stationary contact 182, a conductive path is formed therebetween. To disengage the second lever 188 from the contact 182, the second lever 188 is rotated clockwise about the pivot pin 190 to an open position by depressing the bottom edge of the lever 188. Disengaging the second lever 188 from the contact 182 interrupts the conductive path formed therebetween. As explained below, the presence and absence of the conductive path is used to determine whether or not a coin bag is situated in the bag clamping mechanism 140.

Each pin 186 and 190, which is electrically connected to its respective lever 184 and 188, is connected via a conductive wire to a controller. Further, both contacts 180 and 182 are connected to the controller. In the preferred embodiment, a pair of terminals each having two connectors are molded into the frame 160 during its manufacture. The conductive terminals form respective conductive paths extending upwardly from the respective contact and lever to the surface of the support bracket 162. When the lever 184 is in the closed position and a bag is not engaged in the bag clamping arrangement 140 such that lever 184 engages contact 180, a conductive path is produced between the two connectors of one terminal which passes through the lever 184 and the contact 180. The other terminal corresponds to the second lever 188 and the second contact 182.

However, when a coin bag is engaged in chute 150 of the bag clamping mechanism 140, a flap portion of the bag mouth is wedged between the stationary first contact 180 and the first lever 184 so as to interrupt the conductive path. The same is true for the second contact 182 and the second lever 188 in chute 152. Therefore, by connecting the terminals to the controller and measuring the voltage difference therebetween, the controller can determine whether or not a coin bag is engaged in either chute 150 or 152 of the bag clamping mechanism 140.

A coin bag can be mounted to either the left lower portion 148*a* or right lower portion 148*b*. For simplicity, the following bag securing description is made with reference to left lower portion 148*a* although it is applicable to either portion. To secure a coin bag to the left lower portion 148*a* so as to gather coins which exit down chute 150 of the bag clamping mechanism 140, the mouth of the bag is positioned over the left lower portion 148*a*. Since the mouth of the bag has a larger cross-section than the left lower portion 148*a*, the bag is tightened around the left lower portion 148*a* by passing a loose flap portion of the bag mouth upward through the elongated gap formed between the first prong 166 and the second prong 168. The curvilinear inner edge 176 which gradually curves away from the straight inner edge of the first prong 166 facilitates the insertion of the flap portion within the gap between the first and second prongs 166 and 168.

As the flap portion of the bag mouth is moved upward through the gap, the flap portion disengages the end of the first lever 184 from the stationary contact 180. The flap portion is further moved through the gap until it reaches the upper end of the gap between the first prong 166 and the second prong 168. Since the elongated first lever 184 is biased to a closed position even with the flap portion between the lever 184 and the contact 180, the flap portion of the bag mouth is wedged between the stationary contact 180 and the lever 184.

To strengthen the engagement of the flap portion between the contact 180 and the lever 184, the lever 184 has teeth at its end for gripping the flap portion. The teeth prevent the flap portion from slipping from between the contact 180 and the lever 184. Although teeth are shown, any surface structure which increases the surface roughness of the moveable and/or stationary contacts assists in gripping the bag. Furthermore, the lower left portion 148*a* includes a rectangular projection 200 (FIG. 9B) integrally connected thereto. While moving the flap portion of the bag mouth through the gap between the first and second prongs 166 and 168, the projection 200 supports the rear portion of the bag mouth and prevents the bag mouth from sliding downward off the lower left portion 148*a*. To further enhance the holding capability of bag clamping mechanism 140, the projection 200 could also be a clamping device which grasps the rear of the bag.

Additionally, the clamping mechanism could include sliding members as well. For example, the stationary contact can be an elongated tube positioned vertically with a taper on its upper portion. The moveable contact can be a member that slides to a point along the tapered portion of the elongated tube, but is restricted from moving any further. The bag then would fit over the elongated tube while the sliding member is pulled away from the tapered portion. Finally, after the bag is on slid over the elongated tube with the bag flaps along the tapered portion, the sliding member then slides down over the bag flap and holds it The moveable and sliding member may have teeth or areas of increased surface roughness to assist in holding the bag.

Figure 12B:
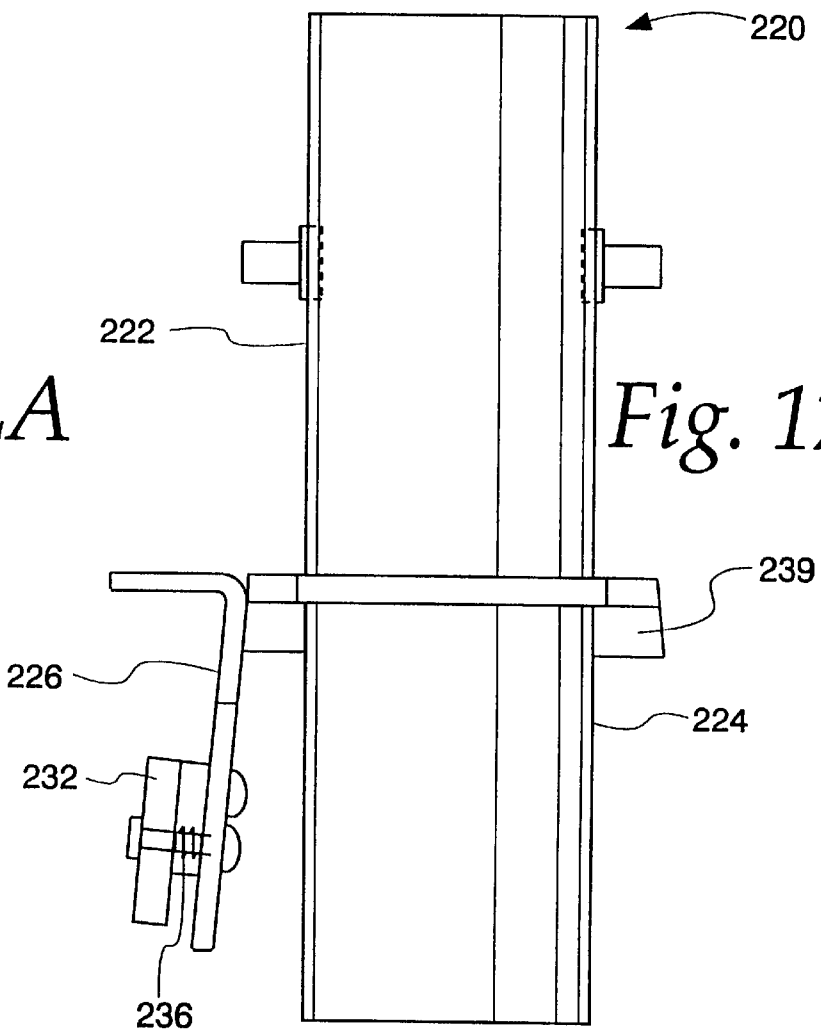
FIGS. 12A–12B are front and side views respectively of a single path bag changing mechanism.
Figure 12A:
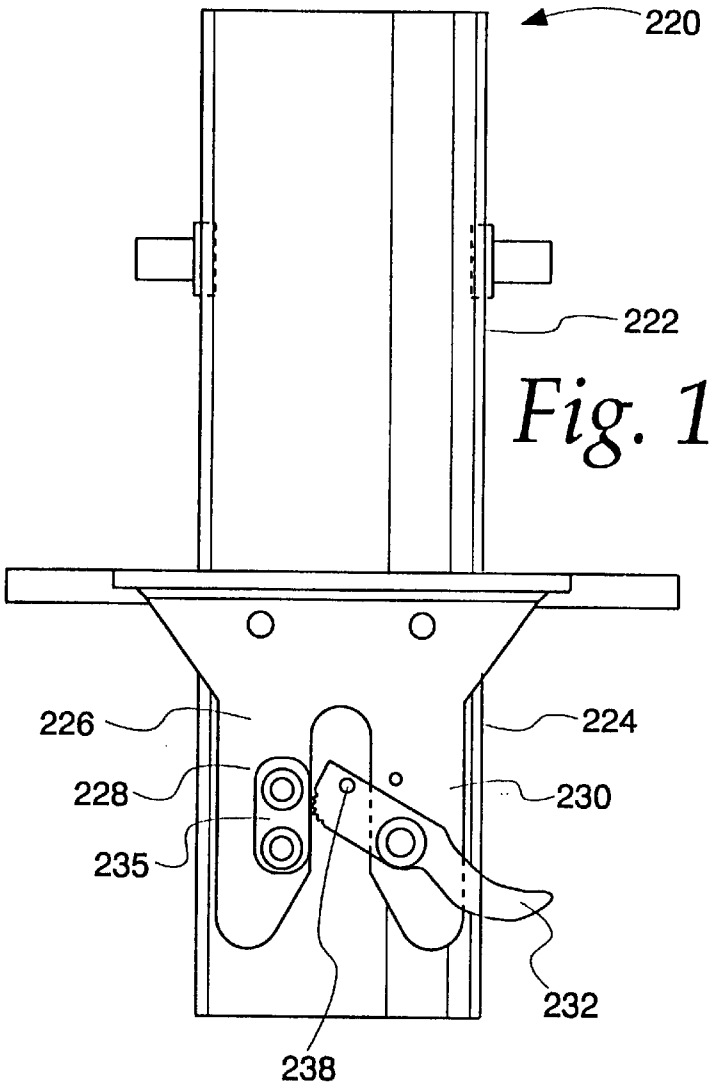

FIGS. 12A and 12B illustrate a similar bag clamping device 220. However, this bag clamping device 220 is a single chute mechanism and lacks the motor and flipper components of the dual chute clamping mechanism 140 of FIGS. 11A and 11B. However, the bag clamping device 220 of FIGS. 12A and 12B includes an upper portion 222 and a lower portion 224. The lower portion 224 has a bracket 226 with a first prong 228 and a second prong 230. A lever 232 is disposed on and pivots about a conductive pin 234 positioned on the second prong 230. A contact 235 is positioned on the first prong 228. A torsional spring 236 is placed around the pin 234 and has an end that is disposed in hole 238 of the lever 232. Further, a projection 237 is present to support the back side of the bag.

The single chute bag clamping device 220 electrically operates in the same manner as described above in reference to the dual chute clamping device 140. Furthermore, a bag is attached to the single chute clamping device 220 in the same manner as described above.

Figure 13:
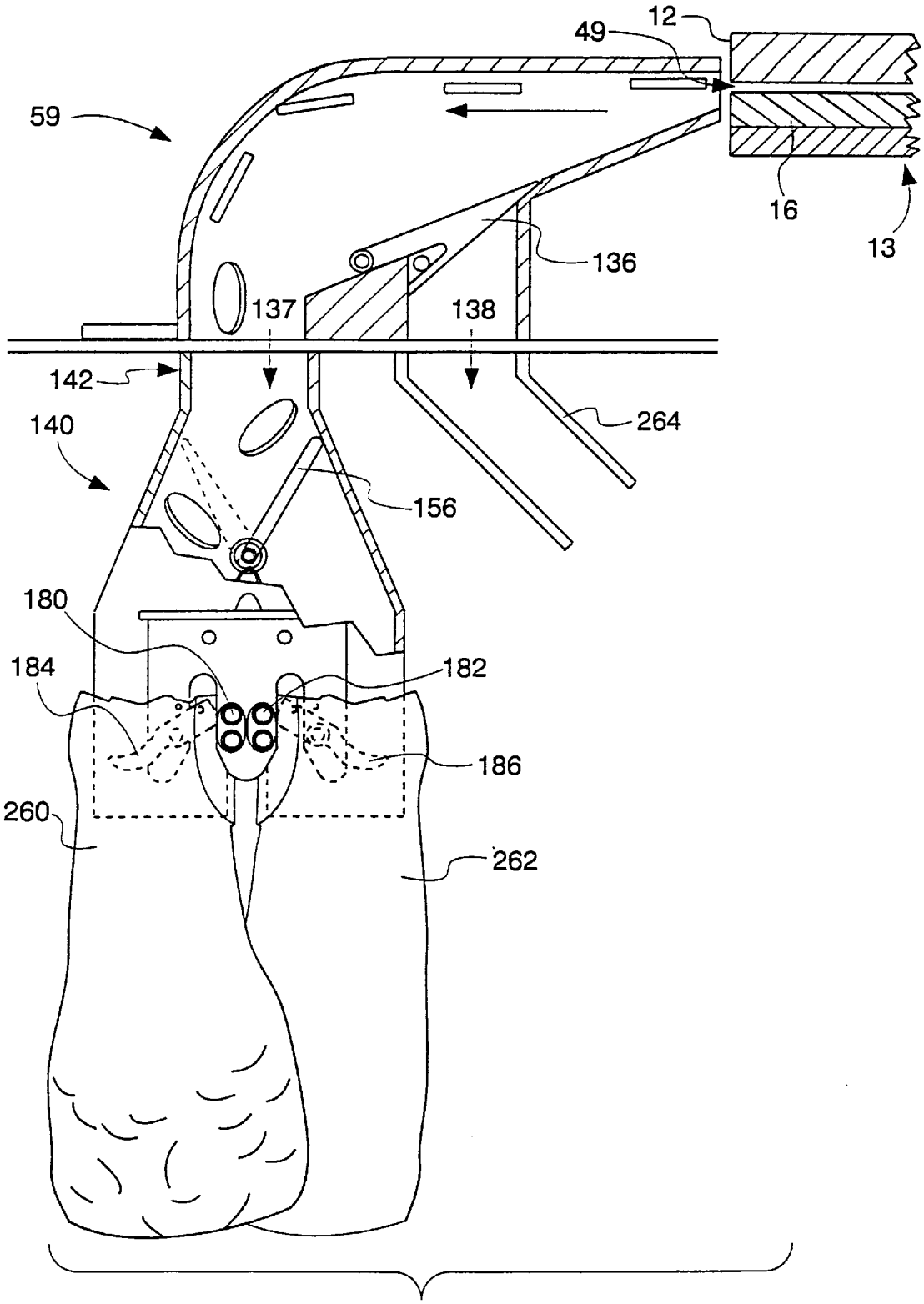
FIG. 13 is a side view of the discriminator shunting mechanism of FIGS. 10A–10D acting in conjunction with the dual path bag holder of FIGS. 11A–11B.

FIG. 13 illustrates the coin chute 59 shown in FIG. 10 cooperating with the bag clamping mechanism 140 of FIG. 11. After the coins are discharged from the exit channel 49 of sorting head 12, the coins enter the coin chute 59. If the coin is not detected to be an invalid coin, the flipper 136 of the coin chute 59 remains in the lower position (as shown) and the coin continues down first chute 137.

After passing through first chute 137 of the coin chute 59, the coin enters the upper portion 142 of bag clamping mechanism 140 where it encounters the flipper 156. The coin then proceeds down either one of two paths into left bag 260 or right bag 262. If the flipper 156 is in the position shown with solid lines, the coin enters left bag 260. Once the left bag 260 has reached its maximum limit of coins, the flipper 156 moves to the position shown by the phantom lines and the coins enter right bag 262. Preferably, the operator then removes the left bag 260 and replaces it with an empty bag before the right bag 262 becomes full.

Figure 16:
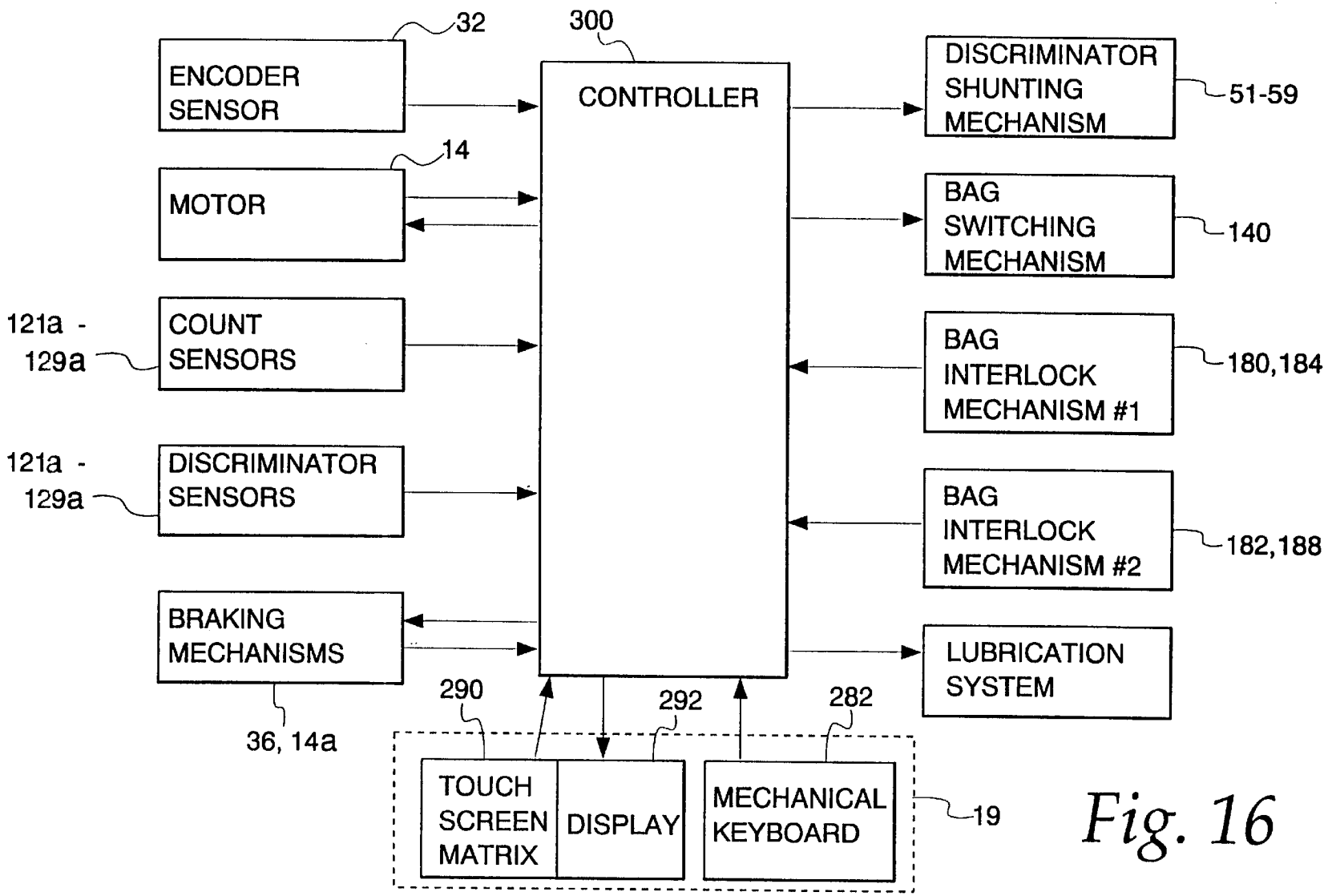
FIG. 16 is an illustration of the controller and the coin sorter components to which it is coupled.

Further, the controller which is described in reference to FIG. 16, monitors the interlocking mechanism (contacts 180 and 182, and levers 184 and 186) holding left bag 260 and right bag 262 to ensure that a closed circuit (lever 184 touching contact 180) is detected which indicates the presence of a bag. If no closed circuit is detected after left bag 260 reaches its limit, then the coin sorter will prohibit flipper 156 from moving after right bag 262 is full. The coin sorter will stop and inform the operator that the left bag 260 must be switched. If this feature were not present, the flipper 156 would guide coins back and forth between two unattended bags which are already full. The bag switching algorithm performed by the controller 30 is described in detail in FIG. 23.

If the discriminator sensor **129*b* (FIGS. 3 and 4) detects an invalid coin, the flipper 136 of the coin chute 59 moves to the upright position and causes the invalid coin to enter chute 138. The invalid coin then enters a tube 264. Preferably, each coin chute 51–59 has a tube, like tube 264 in FIG. 13**, which discharges invalid coins to one common invalid coin collector.

The bag clamping mechanism 140 has geometrical characteristics which make the coin sorter a more efficient system. By providing a substantial distance in the path of the coins between the periphery of the disc 13 and the flipper 156, it takes more time for a coin to encounter the flipper 156. The flipper 156 is usually positioned adjacent the mouth of two bags 260 and 262 with respect to the path of the coins such that it is substantially closer to the mouth of the bags than to the disc 13. Thus, the system controller has additional time to actuate the bag switch motor 158 and move the flipper 156 to the position shown in phantom lines in FIG. 13.

The path of the coin as it exits the disc 13 is usually substantially horizontal. But, given the configuration of the bag clamping mechanism 140, the coin path then turns substantially vertical. A guiding structure, such as the coin chute 59 in FIGS. 10A–10D, may assist the changing of the coin path from horizontal to vertical. Typically, the flipper 156 is positioned away from the periphery of the disc 13 along the vertical segment of the coin path in the range from approximately 10 inches to about 18 inches. Preferably, the flipper 156 is about 15 inches from the periphery of the disc 13.

Due to the spacial relationship between the flipper 156 and the periphery of the disc 13, the controller may only decelerate the disc 13 during an exact bag stop, instead of forcing the disc 13 to come to a complete stop. This reduces the wear on the braking mechanisms **14*a* and 36**. Furthermore, it increases the rate at which coins can be processed.

Figure 14:
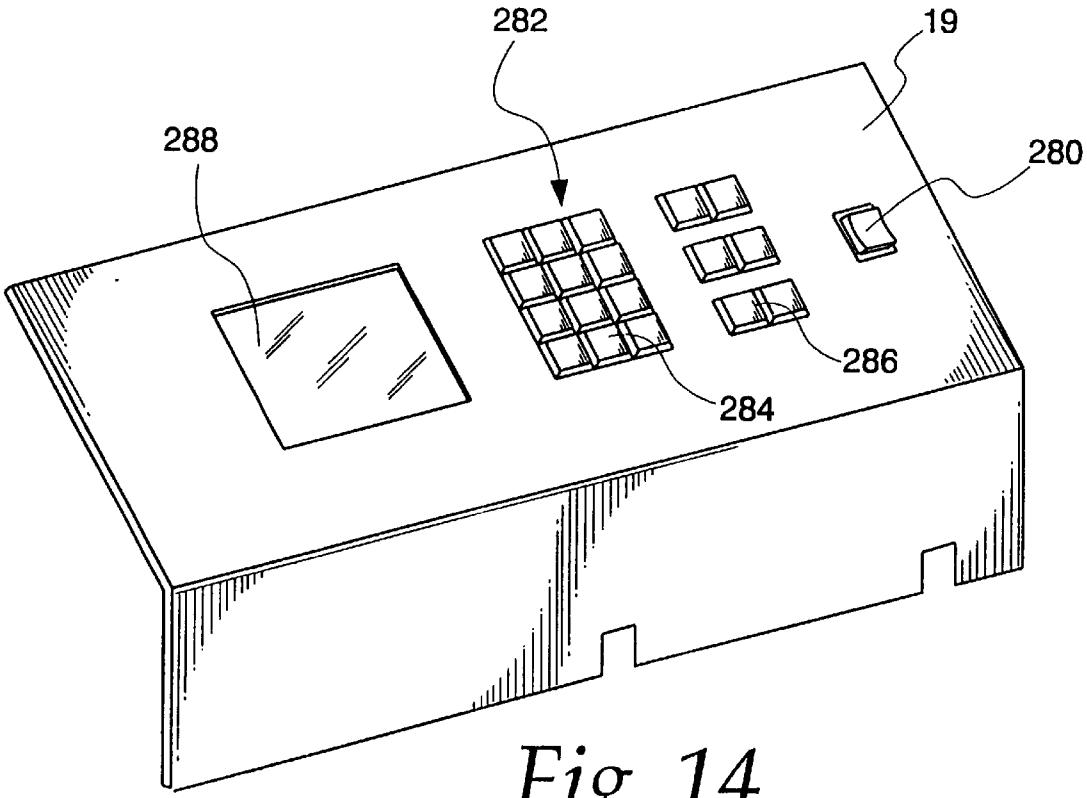
FIG. 14 is a perspective view of the operator control panel illustrated in FIG. 1.

FIG. 14 illustrates the operator control panel 19 of the coin sorter which the user utilizes to operate and control the various functions of the coin sorter. The operator control panel 19 includes a main power switch 280 which powers the entire coin sorter. A mechanical keyboard 282 includes a plurality of keys which the operator depresses. Typically, the mechanical keyboard 282 includes an arrangement of numerical keys 284 and an arrangement of basic function keys 286. A touch screen device 288 is also utilized which makes the operator control panel 19 more user-friendly. Further, employing a touch screen device 288 provides the manufacturer with a great amount of versatility in that numerous types of displays and display keys can be configured.

Figure 15:
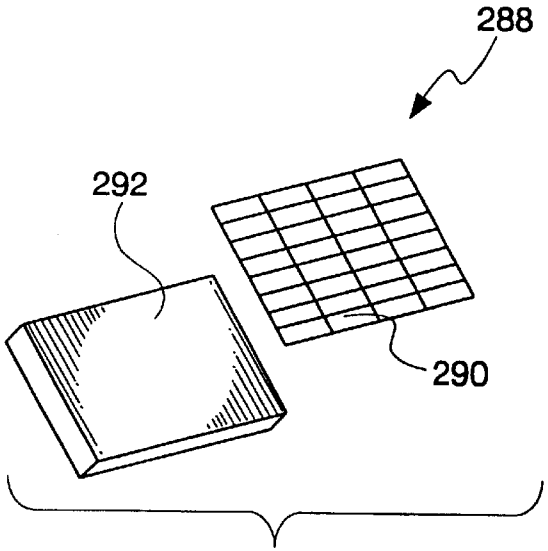
FIG. 15 is a perspective view of a touch screen device from the operator control panel illustrated in FIG. 14.

The touch screen device 288, shown in FIG. 15, is preferably an X-Y matrix touch screen forming a matrix 290 of touch responsive points. The touch screen 288 includes two closely spaced but normally separated layers of optical grade polyester film each having a set of parallel transparent conductors. The sets of conductors in the two spaced polyester sheets are oriented at right angles to each other so when superimposed they form a grid. Along the outside edge of each polyester layer is a bus which interconnects the conductors supported on that layer.

In this manner, electrical signals from the conductors are transmitted to a controller. When pressure from a finger or stylus is applied to the upper polyester layer, the set of conductors mounted to the upper layer is deflected downward into contact with the set of conductors mounted to the lower polyester layer. The contact between these sets of conductors acts as a mechanical closure of a switch element to complete an electrical circuit which is detected by the controller through the respective buses at the edges of the two polyester layers, thereby providing a means for detecting the X and Y coordinates of the switch closure. A matrix touch screen 288 of the above type is commercially available from Dynapro Thin Film Products, Inc. of Milwaukee, Wis.

In the preferred embodiment, the touch screen 288 forms a matrix 290 of ninety-six optically transparent switch elements having six columns and sixteen rows. The matrix 290 is positioned over graphics display 292 which displays display keys. The incorporation of touch screen technology in coin sorters has been disclosed in U.S. patent application Ser. No. 08/301,343, filed Sep. 6, 1994, which is herein incorporated by reference in its entirety.

FIG. 16 illustrates a system controller 300 and its relationship to the other components in the coin sorter. The controller includes a timer, and counter for each of the denominations to be sorted. A main counter may also operate which counts the total number of coins counted by the coin sorter. The operator communicates with the coin sorter via the operator interface panel 19. The operator inputs information through the mechanical keyboard 282, or through the touch screen device matrix 290 of the touch screen 288. The graphics display 292, which is part of the touch screen device 288, is the component used by the controller 300 to inform the operator about the functions and operation of the coin sorter.

The touch screen device 288 allows the operator to enter three main modes: an operational mode, a set-up mode, and a diagnostics mode. Typically, the operator selects either the set-up mode or diagnostics mode when in the operational mode. When this occurs, the controller 300 is likewise placed into either of these modes.

When the controller 300 is in the set-up mode, the controller 300 causes the display 292 to initially display the set-up menu illustrated in FIGS. 17A and 17B. The primary display pattern provides, for example, the following set-up options: ENABLE KEYS, ENABLE FUNCTIONS, DATA ENTRY SELECTIONS, PORT SET-UP, DISCRIMINATOR LEARN, USER DEFAULTS, BOX/BAG CONFIGURATION, REPOSITION KEYS, KEY LEGENDS, SCREEN COMPLEXITY, and LUBRICATION. Additional set-up options are available as well. The key legends are located beside their respective keys, as opposed to within their respective keys, because the legends are too lengthy to fit within the keys.

Since the key legends occupy a relatively large portion of the display 292, all of the set-up options would not reasonably fit on a single primary display pattern. Therefore, the primary display pattern is divided into two portions which are separately displayed on the display 61 using the MORE and BACK keys. Only one of the two portions is shown on the display 292 at any given time. If FIG. 17A represents the portion of the primary display pattern currently on the display 292, the operator presses the MORE key to cause the display 292 to display the portion of the primary display pattern shown in FIG. 17B. Similarly, if FIG. 17B represents the portion of the primary display pattern currently on the display 292, pressing the BACK key causes the display 292 to display the portion of the primary display pattern shown in FIG. 17A. To modify the current settings of a particular set-up option in FIGS. 17A–17B, the operator presses the displayed key of that set-up option. Pressing the displayed key causes the controller 300 to display on the display 292 a secondary display pattern (sub-menu) for the option selected. To assist the operator in understanding the meaning of the various keys in the secondary display pattern, the secondary display pattern includes a HELP key. When the operator has completed his/her modifications to the current settings of the set-up option, the operator returns to the primary display pattern (main set-up menu) by pressing an EXIT key.

When the controller 300 is in the diagnostic test mode, the controller 300 causes the display 292 to initially display the primary display pattern (main diagnostics menu) illustrated in FIGS. 18A–18B. The primary display pattern provides, for example, the following diagnostic test options: MEMORY INFORMATION, ENCODER & COIN SENSORS, KEYBOARD, MOTOR, COIN THRUPUT, COIN STOP, BRAKE CYCLE, REMOTE DISPLAY, and MACHINE STATISTICS. Additional diagnostic options may be available as well. The key legends are located beside their respective keys, as opposed to within their respective keys, because the legends are too lengthy to fit within the keys.

Since the key legends occupy a relatively large portion of the display 292, all of the diagnostic test options would not reasonably fit on a single primary display pattern. Therefore, the primary display pattern is divided into two portions which are separately displayed on the display 292 using the MORE and BACK keys. Only one of the two portions is shown on the display 292 at any given time. If FIG. 18A represents the portion of the primary display pattern currently on the display 292, the operator presses the MORE key to cause the display 292 to display the portion of the primary display pattern shown in FIG. 18B. Similarly, if FIG. 18B represents the portion of the primary display pattern currently on the display 292, pressing the BACK key causes the display 292 to display the portion of the primary display pattern shown in FIG. 18A. To select a particular diagnostic test option in FIGS. 18A–18B, the operator presses the displayed key of that diagnostic test option.

Depending upon the selected diagnostic test, the controller 300 either automatically performs the selected diagnostic test or prompts the operator to enter numerical data (using the numeric keypad) prior to performing the diagnostic test. The prompts for data entry and the results of the selected diagnostic test are displayed on the display 292 as secondary display patterns. To assist the operator in performing the diagnostic tests, the secondary display pattern(s) associated with each diagnostic test include a HELP key. When the operator has completed a diagnostic test, the operator returns to the primary display pattern (main diagnostics menu) by pressing an EXIT key.

Returning to FIG. 16, the controller 300 receives signals from the encoder sensor 32 which monitors the movement of the encoder 30. The encoder 30 has numerous uniformly spaced indicia spaced along its circular periphery which the encoder sensor 32 detects. The indicia can be optical or magnetic with the design of the encoder sensor 32 being dependent on which type of indicia is utilized.

Because the encoder 30 is fixed to the disc 13, it rotates at the same rate as the disc 13. As the encoder 30 rotates, the indicia are detected by the encoder sensor 32 and the angular velocity at which the disc 13 is rotating is known by the controller 300. And, the change in angular velocity, that is the acceleration and deceleration, can be monitored by the controller 300 as well.

Furthermore, the encoder system can be of a type commonly known as a dual channel encoder in which two encoder sensors are used. The signals which are produced by the two encoder sensors and detected by the controller 300 are generally out of phase. The direction of movement of the disc 13 can be monitored by utilizing the dual channel encoder.

The controller 300 also controls the power supplied to the motor 14 which drives the rotatable disc 13. And, because it is often necessary to know whether the motor 14 is operational, the controller 300 detects the amount of power supplied to the motor 14. Typically, this is accomplished by a current sensor which senses the amount of current being supplied to the motor.

Still in reference to FIG. 16, the controller 300 also monitors the counting sensors 121*a*–129*a* which are stationed within the sorting head 12. As coins move past one of these counting sensors 121*a*–129*a*, the controller 300 receives the signal from the counting sensor for the particular denomination of the passing coin and adds one to the counter for that particular denomination within the controller 300. The controller 300 has a counter for each denomination of coin that is to be sorted. In this way, each denomination of coin being sorted by the coin sorter has a count continuously tallied and updated by the controller 300.

The discriminator sensors 121*b*–129*b* are also coupled to the controller 300. The discriminator sensors 121*b*–129*b* can operate by comparing numerous physical characteristics of the coin to a predetermined characteristic pattern which is stored in the memory of the controller 300.

The coin discriminator sensors 121*b*–129*b* detect invalid coins on the basis of an examination of one or more of the following coin characteristics: coin thickness; coin diameter; imprinted or embossed configuration on the coin face (e.g., U.S. penny has profile of Abraham Lincoln, U.S. quarter has profile of George Washington, etc.); smooth or milled peripheral edge of coin; coin weight or mass; metallic content of coin; conductivity of coin; impedance of coin; ferromagnetic properties of coin; imperfections such as holes resulting from damage or otherwise; and optical reflection characteristics of coin.

With further reference to FIG. 16, the controller 300 also controls the disc braking mechanism 36 and the motor brake mechanism 14*a* which are typically connected in series. The controller 300 accomplishes this by applying power to a brake actuator for each brake mechanism 36, 14*a*. The amount of power applied is proportional to the braking force which the braking mechanisms 36, 14*a* apply. Thus, the controller 300 has the capability to alter the deceleration of the disc 13 by varying the power applied to the braking mechanism 36, 14*a*. This feature is described in more detail in reference to FIG. 22.

Still in reference to FIG. 16, the controller 300 controls the movement of the shunting mechanism (flipper 136 in FIGS. 8B and 8C) in the coin chutes 51–59 to separate invalid coins from valid coins. When one of the discriminator sensors 121*b*–129*b* senses a coin and sends a signal received by the controller 300 that the controller 300 determines to be outside the predetermined range of acceptable signals for a particular denomination, the controller 300 then actuates the motor 135 (FIGS. 10A–10C) which moves the flipper 136. In this way, the coin sorter detects the invalid coin and separates it from the bag of valid coins. Further, when the controller 300 determines a coin is invalid, it reduces, by one, the current count of coins which have been sorted and sent to a bag, since the invalid coin does not enter the bag, but instead is discharged otherwise.

The controller 300 of FIG. 16 is also coupled to the dual bag clamping mechanism 140 (FIGS. 9A–9B). As the mixed coins are sorted, the controller 300 maintains a running count of the coins for each denomination discharged from the exit channels 41–49 into each bag. When the number of coins counted by the counting feature in the controller 300 and discharged into a bag reaches a predetermined value, the controller 300 applies power to the bag switch motor 158 which moves the flipper 156. The coins then begin to enter the second bag while the operator removes the full bag and replaces it with an empty bag.

The controller 300 is also coupled to both bag interlock mechanisms if the dual bag clamping mechanism 140 (FIGS. 11A and 11B) is utilized. Alternatively, if the single bag clamping mechanism 220 (FIGS. 12A and 12B) is utilized, then only one bag interlock mechanism is coupled to the controller 300. In either case, when the counter in the controller 300 reaches its predetermined limit for the amount of coins in one bag, the controller 300 indicates to the operator via the display 292 that the bag must be switched.

The bag interlock mechanism also prohibits sorting anytime one of these devices has a closed circuit. This ensures that coins are not discharged into a bag clamping mechanism which has no bag attached thereon. The bag interlock mechanism and its relationship with the controller is described below in reference to FIG. 23.

With further reference to FIG. 16, the lubrication system is coupled to the controller 300 to allow the coins to pass through the sorting head 12 with minimal friction. The lubrication is supplied to the sorting head 12 through lubrication port 93 (shown in FIGS. 3 and 4) to minimize the friction due to metal-to-metal contact. As stated previously, the controller 300 is coupled to a pump which conveys the fluid from the reservoir through the supply line 26 to the lubrication port 93. Alternatively, the controller 300 may be coupled to a valve in the supply line 26 which is opened or closed by the controller 300.

Depending on the use of the coin sorter, the amount and the frequency of the lubrication varies. For example, in coin sets from countries which use softer metals to produce coins, lubrication occurs more frequently. Also, some coin sorters are exposed to more slugs and invalid coins, such as those machines which sort coins collected from public transportation. These types of coin batches lead to additional wear on the machine. Consequently, the coin sorter must be capable of varying the amount and frequency of lubrication.

By way of the touch screen 288, the operator enters the set-up mode in which the LUBRICATION option is available (FIG. 15B). The operator selects the lubrication option which produces a screen on the display 292 which allows the operator to vary the frequency and the amount of oil released at the lubrication port 93. Typically, the operator chooses a number between 1 and 99 for the number of coins (in thousands) between which lubrication occurs (frequency). Thus, if the operator chooses "32", then the pump or valve controlled by the controller 300 is actuated after total 32,000 coins have been processed.

Further, the amount of oil discharged can be varied by the operator as well. The operator enters the pulse length of the power supplied to the pump, or the duration that the valve remains open. For example, when a pump is used, the operator selects a number between 1 and 999 which is in units of hundredths of a second. Thus, if the operator chooses 177, then the pulse length of the pump is 1.77 seconds. The larger the number chosen by the operator, the more lubrication released through the lubrication port 93 in the sorting head 12.

Furthermore, by selecting the LUBRICATION display key in the set-up mode, the operator can select a lubrication "prime" key. When this key is depressed the lubrication pump operates, or the valve remains open. This allows the supply line 26 to be filled with lubrication such that it is ready for the periodic pulses which release the lubrication. Typically, the operator releases the latches 23*a* and 23*b* (FIGS. 1 and 2) and pivots the sorting head 12 about the hinge 22 (FIGS. 1 and 2) to the upward position. As the operator depresses the prime key on the touch screen 288, he or she watches the lubrication port 93 to see when lubrication has completely filled the supply line 26 and is present at the lubrication port 93. At this point, the sorting head 12 is returned to its operational position.

Figure 19:
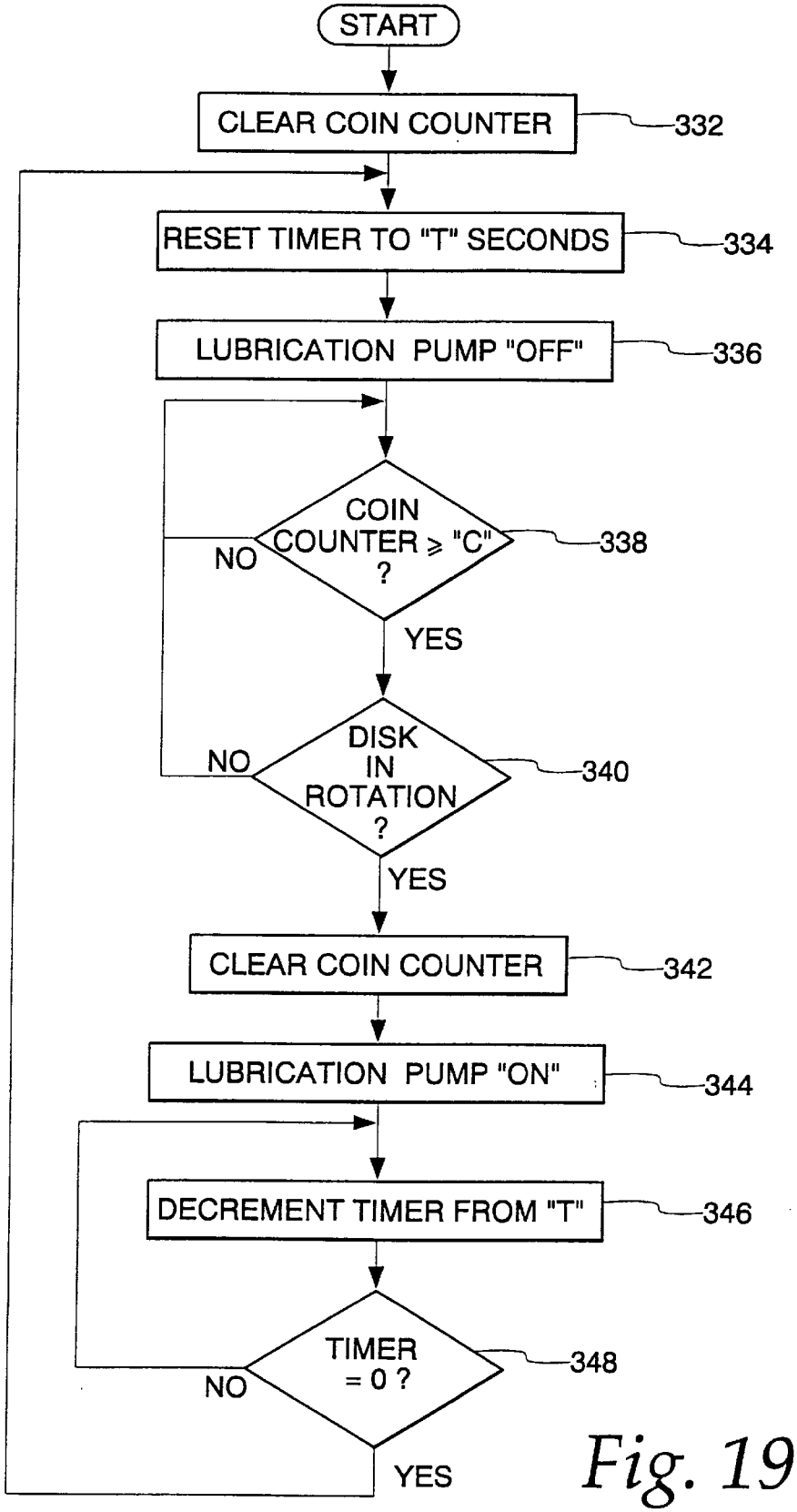
FIG. 19 is a flow chart illustrating the sequence of operations used to actuate the lubrication pump at predetermined time intervals.

FIG. 19 is a flow chart illustrating the sequence of events which occur during the lubrication process of the coin sorter when a pump is used. As previously stated, the controller 300 includes a main coin counter and a timer. The coin sorter has a default setting corresponding to the number of coins "C" which must be counted before activating the pump. Also, the controller has a default pump pulse width "T"

(seconds) during which the pump is activated. Of course, the operator can change these parameters via the touch screen device 288 in the set-up mode to best fit the operational conditions of the particular coin sorter as previously described.

The main coin counter is initially cleared to zero (step 332). The count-down timer is initially loaded with a value of "T" microseconds (step 334), and the lubrication pump is initially "off" (step 336). As coins are processed with the coin sorter, the counter maintains a running total of the number of coins detected by the counting sensors 121*a*–129*a* in the exit channels 41–49.

After each coin is sensed, the controller 300 compares the value of the counter with value "C" (step 338). In response to the coin count being equal to or greater than the predetermined number "C" of processed coins, the controller 300 then checks to see that the disc 13 in still in rotation (step 340) If the disc 13 is not in rotation, then the sequence returns to step 338. This ensures that the lubrication is not dispensed from the lubrication port 93 while the disc 13 is stationary which may lead to lubrication being deposited onto the pad 16. The next time the coin sorter is rotating, the lubrication will be discharged.

If the disc 13 is in rotation, then the controller 300 actuates the pump by sending a positive signal to the pump switch circuit which drives the pump (step 344). In response to the controller 300 turning "on" the pump in step 344, the timer counts down to zero from "T" seconds (step 346). Typically, the value of "T" ranges from about 0.1 second to about 9.99 seconds. After "T" seconds have elapsed and the timer is at 0 seconds (step 348), the controller 300 resets the timer to "T" seconds (step 334). Then, the controller 300 turns off the pump (step 336). The pump remains "off" until the predetermined number "C" of coins have once again passed through the exit channels 41–49 of the coin sorter.

Figure 20:
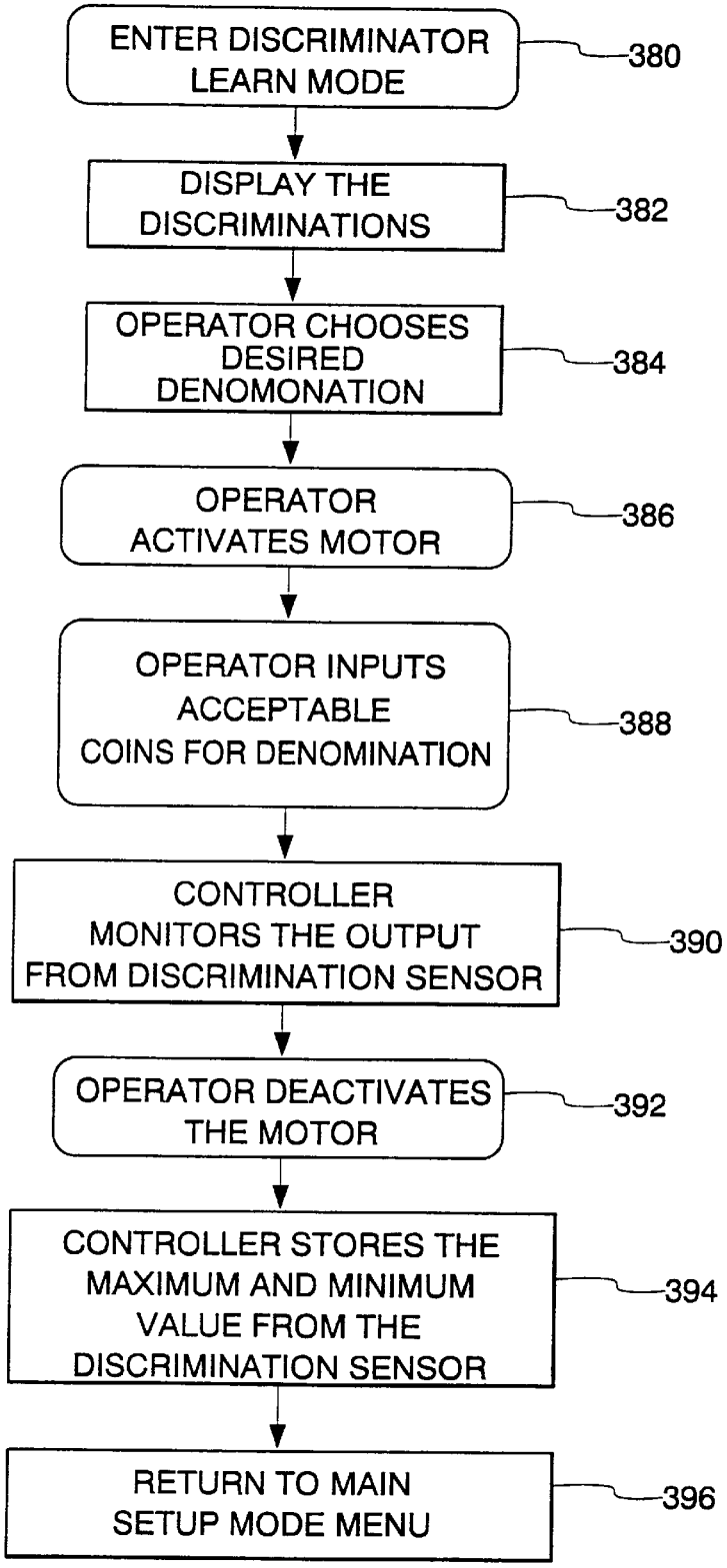
FIG. 20 is a flow chart illustrating the sequence of operations used to store the characteristic coin patterns against which the coins are compared for validity.

FIG. 20 is a flow chart which illustrates the method by which a characteristic pattern for each coin denomination is stored into the memory of the controller 300. The process is implemented by the operator first selecting the DISCRIMINATOR LEARN display key (FIG. 17A) in the set-up mode (step 380). The controller 300 then displays a listing of denominations (step 382) from which the operator chooses one denomination that is to have its characteristic pattern stored (step 384).

After the operator chooses the desired denomination, the operator depresses the keys on the operator control panel 19 which activate the motor 14 to drive the disc 13 (step 386). The operator then places a variety of acceptable coins from the desired denomination into the hopper 12 (step 388). Preferably, the coin sorter is loaded with a diverse (age and wear level) set of coins from that denomination. The more diverse and the larger the quantity, the more accurate the tolerance range will be.

As the coins pass by their respective discriminator sensors 121*b*–129*b*, the controller 300 stores the value of a predetermined characteristic for each coin (step 390). The coin sorter remains activated until each coin has passed by the discriminator sensor and the operator deactivates the motor 14 (step 392). The controller 300 then searches for the high and low values which were detected for the set of coins passing by the discriminator sensor. The maximum value and the minimum value are stored and used as the outer boundaries which define the tolerance range for that particular coin denomination (step 394). The controller then returns to the main set-up mode menu (step 396) wherein the operator can again select the DISCRIMINATOR LEARN key co perform the same process for other denominations.

Consequently, when the coin sorter is operational, the controller 300 receives a signal from the discriminator sensors 121*b*–129*b* and compares the signal to the predetermined characteristics in its memory. The controller 300 is able to detect invalid coins and prevent their discharge into a bag of valid coins.

Figure 21:
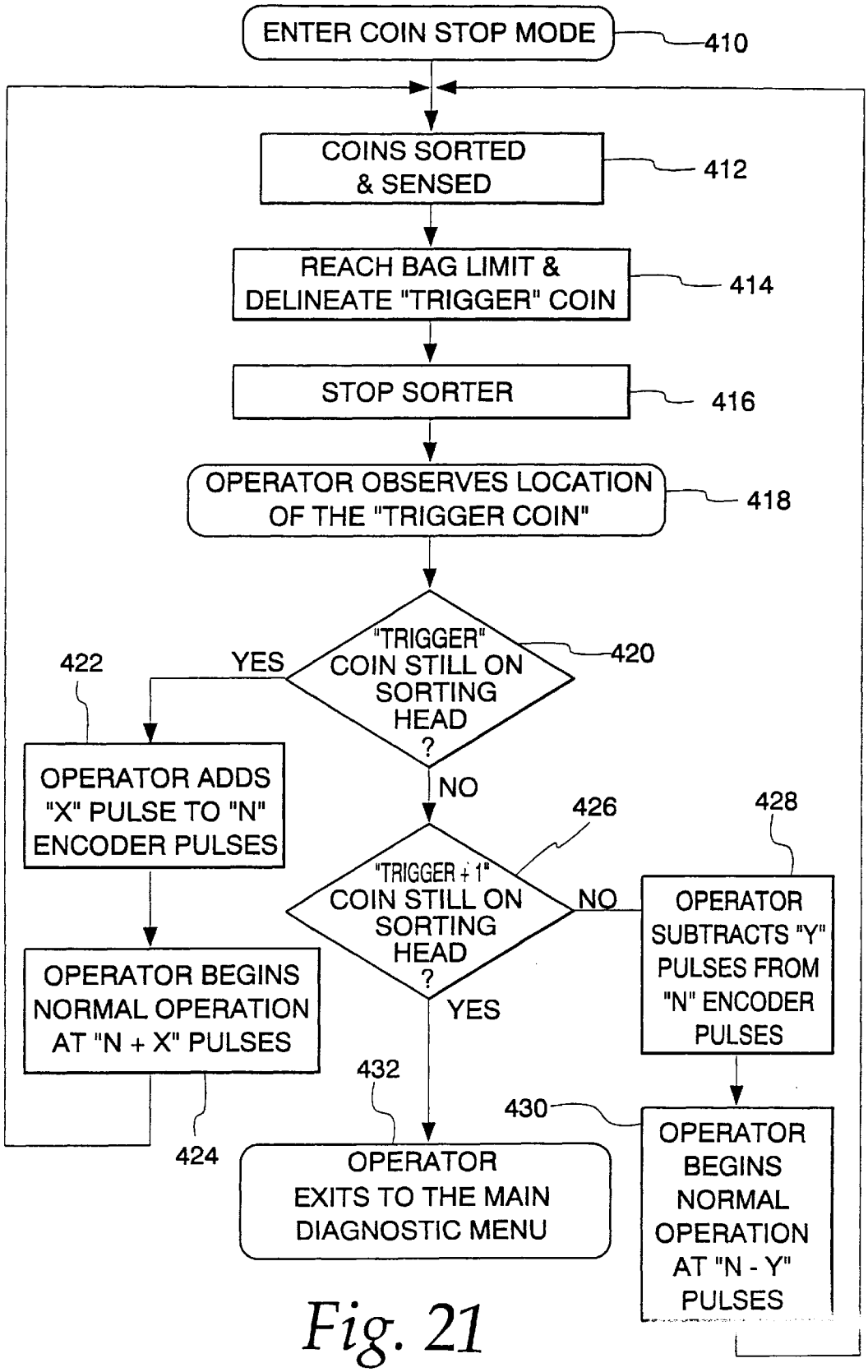
FIG. 21 is a flow chart illustrating the sequence of operations used to alter the number of encoder pulses required for a trigger coin to be discharged after being sensed.

FIG. 21 is a flow chart which illustrates the coin stop adjust feature which is entered by depressing the COIN STOP key in the diagnostics mode of FIG. 18B. This feature allows the operator to adjust the number of encoder pulses which is required to discharge the coin from the periphery of the disc after it has passed by the counting sensor 121*a*–129*a*. For example, the memory of the controller 300 has a value stored therein which is the number of encoder pulses "N" which must be sensed before a coin of a particular denomination is discharged after the coin passes by its respective counting sensor 121*a*. When the last coin to enter a bag (trigger coin) is sensed and the disc 13 stops to effectuate an exact bag stop, the controller 300 knows that the disc 13 must advance its angular position by "N" encoder pulses after the coin is sensed for that trigger coin to be released from the periphery of the bag. Thus, when the braking mechanisms 36 and 14*a* are applied, the controller 300 knows whether it needs to advance the disc 13 to release the trigger coin. The same process occurs when an invalid coin (trigger coin) is detected, except that it is now desired to retain the trigger coin within the periphery of the disc 13, and not discharge it into the baa.

However, deviations in the motor drive mechanism or the braking mechanisms can cause the trigger coin to be retained within the sorting head 12 or the coin following the trigger to be discharged after "N" encoder pulses. Further, the wear on the pad 16 or the sorting head 12 can also result in "N" encoder pulses being the incorrect value. Thus, the routine in FIG. 21 allows the user to modify the "N" value of encoder pulses to "fine tune" the coin sorter.

When the operator depresses the COIN STOP key (step 410), the coin sorter is now ready for operation. The operator places coins of the denomination in which a discharge problem is suspected into the hopper 12 and the coins begin to be sorted and sensed (step 412). When a bag limit is reached, the trigger coin (the last to enter a bag) is selected (step 414). The controller 300 then stops the disc 13 (step 416).

The trigger coin is now either on the disc 13 or in the bag. The operator then checks the exit channel to see if the trigger coin is still on the disc 13 (step 418). If the trigger coin is still on the disc 13 (step 420), then the operator adds a number of additional encoder pulses, "X", (step 422) to the value "N" to ensure the trigger coin will exit then next time the disc 13 is operated. The operator then begins normal operation (step 424) and the coins are processed as this iterative process is again initiated (step 412) with the new value of "N+X" encoder pulses as the target value.

However, if the operator detects that the trigger coin has exited the sorting head 12 in step 420, the operator then checks to see the position of the coin immediately following the trigger coin—the "trigger+1" coin (step 426). If the "trigger+1" has exited the sorting head 12, then the operator knows the number of encoder pulses must be decreased to maintain the "trigger+1" coin within the sorting head 12. The operator then subtracts a number of encoder pulses, "Y", from the value "N" with the hope that the "trigger+1" coin will now remain on the disc 13 (step 428). The operator then begins normal operation at "N−Y" encoder pulses as the target value (step 430).

If the "trigger+1" coin remains on the disc 13 (step 426), then the coin sorter is operating correctly. No modifications are needed and the operator instructs the coin sorter to exit the COIN STOP feature and return to the main diagnostics menu (step 432).

As can be seen, the COIN STOP feature allows the operator of the coin sorter to ensure that the last coin which should enter the coin collection receptacle does, in fact, enter the receptacle without the coin following the last coin (the first coin for the next batch) entering the receptacle. Furthermore, the COIN STOP feature could take on a slight variation and allow the operator to delineate a certain coin (e.g. the twentieth coin) to be an invalid coin. When the twentieth coin is detected, the coin sorter should stop and retain that coin within the periphery of the disc 13. If it does not, the operator could then vary the encoder pulses required to properly accomplish a stop for an invalid coin.

Figure 22:
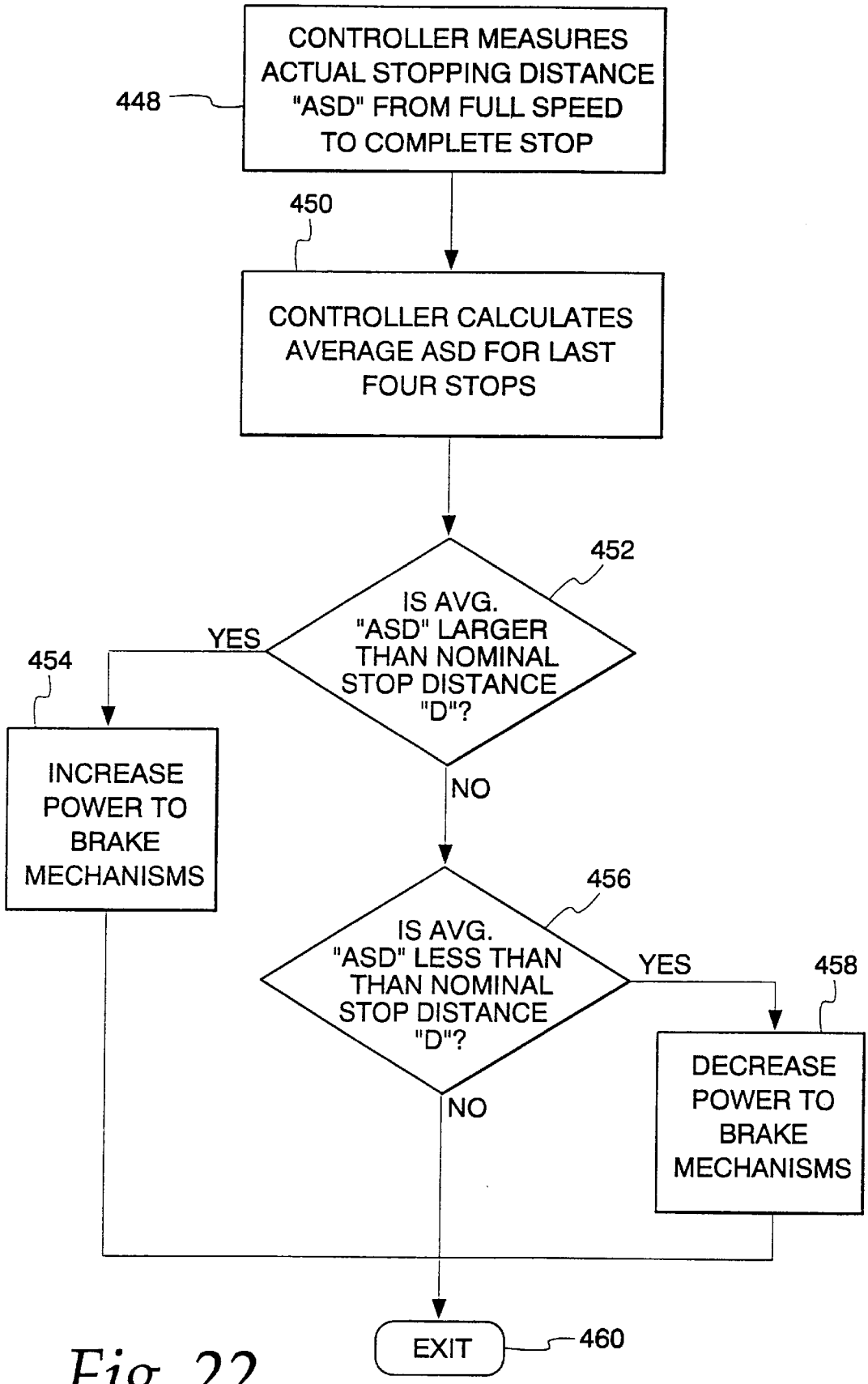
FIG. 22 is a flow chart illustrating the sequence of operations used by the controller to alter the power applied to the braking mechanism.

In FIG. 22, a flow chart of the self-adjusting brake feature is illustrated. This process is completely internal to the controller 300 in that no operator inputs are required. In essence, it is transparent to the operator. Each time the coin sorter comes to a stop, whether it is due to the detection of an invalid coin or an exact bag stop, the controller 300 applies power to motor brake mechanism 14*a* and the rotatable disc brake mechanism 36 such that the rotatable disc 13 comes to stop. The controller 300 is programmed such that when power P is applied to the braking mechanisms 14*a* and 36, the disc 13 should stop rotating within a nominal angular distance "D". Different sizes of coins require a different number of encoder pulses for the coin to exit the periphery of the sorting head 12. Furthermore, when an invalid coin is detected, that coin must remain within the periphery of the sorting head 12. The value of "D" is chosen as the minimum amount of encoder pulses in which the disc 13 must stop to accomplish the exact bag stop feature or the invalidity detection feature.

Thus, each time the controller 300 causes the rotatable disc 13 to stop, the controller 300 measures the actual stopping distance, the "ASD" (step 448). The controller 300 then calculates the average ASD of the last four stops (step 450). The controller 300 then compares the average ASD with the distance "D" (step 452). If the average ASD is larger than "D", then the controller 300 increases the amount of braking power that is to be applied the next time the disc 13 stops (step 454).

However, if the average ASD is not larger than distance "D", then the controller 300 examines to see if the average ASD is less than the distance "D" (step 456). If the average ASD is less than the distance "D", then the controller 300 decreases the power applied to the braking mechanisms 14*a* and 36 the next time the disc 13 stops (step 458). Otherwise, if the average ASD is at distance "D", then the controller 300 exits the routine without adjusting the brake power (step 460).

The amount of the increase or decrease that occurs in steps 454 and 458 can vary. For example, the controller 300 can adjust the amount of power very slightly so that the average ASD moves slowly to the acceptable distance "D" over a number of stops. Alternatively, the controller 300 can be programmed to quickly move the average ASD to distance "D". For example, if the average ASD is off 10% from "D", then the controller 300 adjusts the amount of power applied to the brake mechanisms 36 and 14*a* by a percentage known to produce the 10% change in stopping distance. Thus, the controller 300 may have a look-up table stored into its memory which has a percentage change in ASD and its corresponding percentage change in power. Further, a tolerance can be added to distance "D" against which ASD is compared. The controller would then make less adjustments to the applied brake power.

Figure 23A:
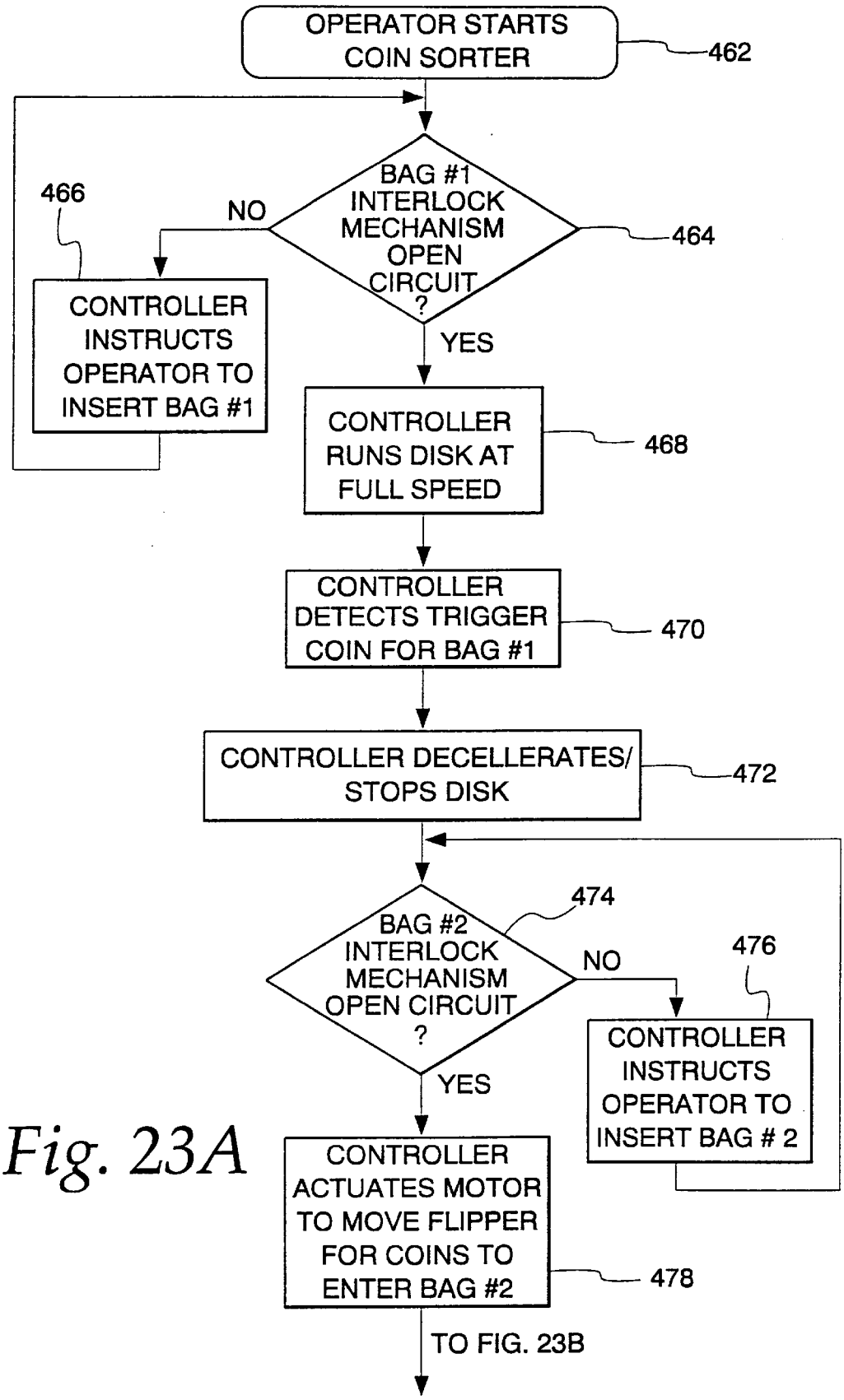
FIGS. 23A and 23B are flow charts illustrating the sequence of operations used by the controller to ensure a bag is clamped on the bag clamping mechanism.
Figure 23B:
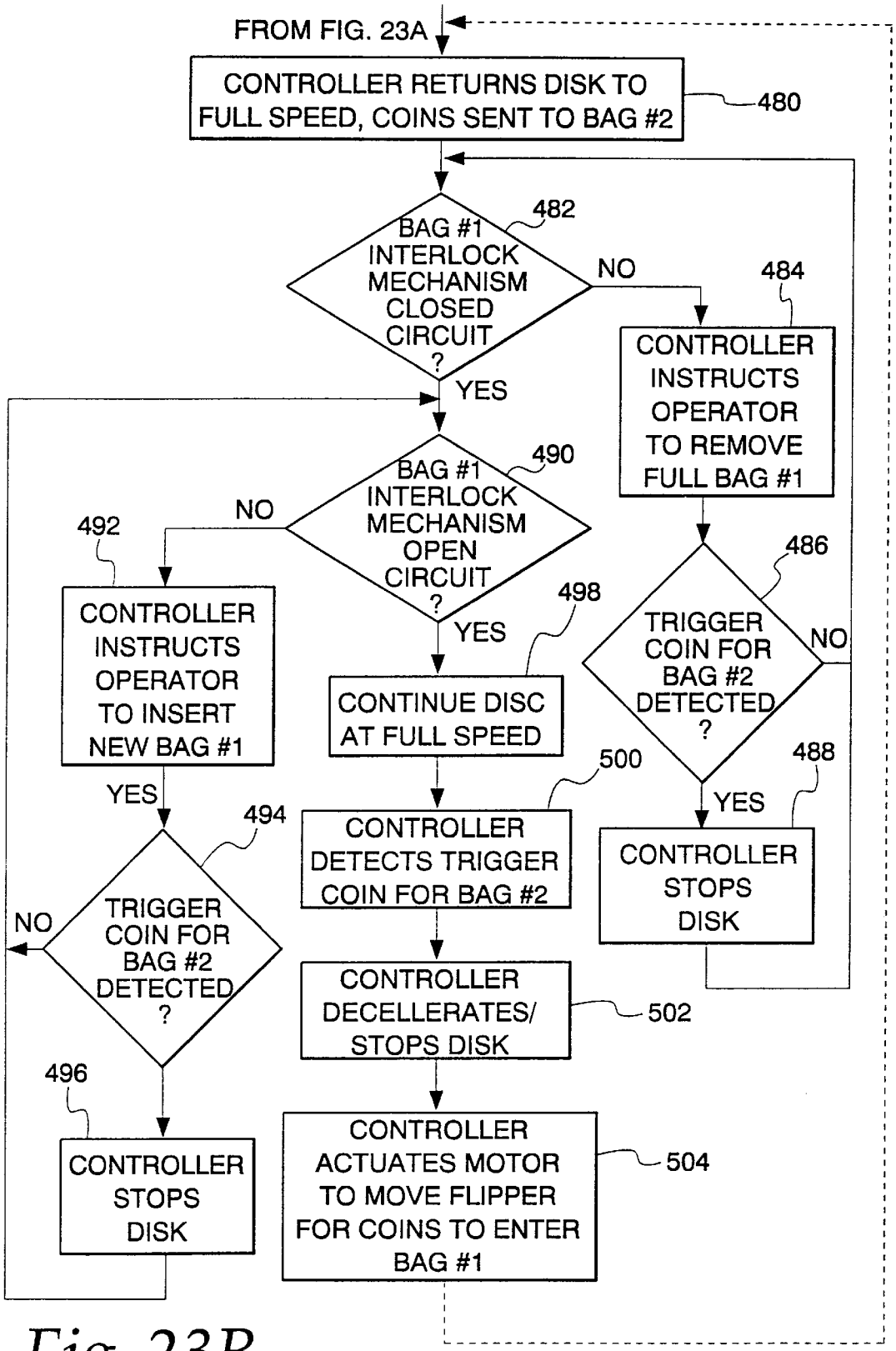

FIG. 23 is a flow chart which illustrates the algorithm that the controller 300 undertakes when the dual path bag clamping mechanisms 140 of FIGS. 11A and 11B are used in the coin sorter. When the dual bag clamping mechanism 140 is used, the coin sorter continues operation after the first bag is full since the coins can then be sent to the alternate bag. This increases the overall efficiency of the system since the coin sorter continues to process coins while the operator switches bags.

In FIG. 23, the operator places the coin sorter in a state in which it can begin operation with the flipper 156 (FIGS. 9A and 9B) in a position to discharge coins into bag #1 (step 462). The controller 300 then checks to ensure that the bag interlock mechanism for bag #1 is in an open state (contact 180 not contacting lever 182) which indicates the presence of bag #1 (step 464) If bag #1 is not detected, the controller instructs the operator via the display 292 to insert bag #1 (step 466). If the interlock mechanism is in an open state such that bag #1 is present, then the coin sorter operates with the disc 13 at full speed (step 468).

As the coin sorter operates and discharges coins of a particular denomination into bag #1, the trigger coin for bag #1 (i.e. the last coin to enter bag #1) is eventually detected (step 470). The controller 300 then decelerates or stops the rotatable disc 13 to ensure the coin following the trigger coin does not enter bag #1 (step 472). Thus, bag #1 contains the correct amount of coins. This feature is known as the Exact Bag Stop (EBS). Before returning to full speed, the controller 300 checks to ensure the bag interlock mechanism (lever 188 and contact 182) for bag #2 is in the open circuit state which occurs when bag #2 is present. (step 474). If the interlock mechanism for bag #2 is not in an open circuit (closed circuit), then the controller 300 instructs the operator via the display 292 to insert bag #2 (step 476). If bag #2 is already present or once the operator has inserted bag #2, then the controller 300 actuates the bag switch motor 158 to move flipper 156. The controller 300 then returns to full speed with the coins now being discharged into bag #2 (step 480).

The controller 300 then monitors the interlock mechanism of bag #1 (contact 180 and lever 184) to ensure the operator removes full bag #1 which causes a closed circuit in the bag interlock mechanism (step 482). If a closed circuit in the bag interlock mechanism is detected by the controller 300, then the operator has removed the full bag #1. If the controller 300 detects a constant open circuit, then the full bag #1 still remains in position and the controller 300 instructs the operator through the display 292 on the operator interface panel 19 to remove full bag #1 (step 484). The controller 300 then checks for the trigger coin for bag #2 (step 486). If it is detected, then the controller 300 stops the disc 13 after the trigger coin has passed into bag #2 (step 488).

Once the operator has removed the empty bag #1 for the bag clamping mechanism 140, then the controller 300 checks to ensure a new bag has been placed therein (step 490). If the bag interlock mechanism 140 for bag #1 has a closed circuit, then no bag is present and the controller 300 instructs the operator via the display 292 to insert the new bag #1 (step 492). Further, the controller 300 checks for the trigger coin for bag #2 (step 494). If the trigger coin is detected for bag #2, then the controller 300 stops the disc 13 after the trigger coin has entered bag #2 (step 496).

Once the operator has inserted a new bag #1, then the controller 300 continues the disc 13 at full speed (step 498). When the controller 300 detects the trigger coin for bag #2 (step 500), the controller 300 decelerates or stops the disc 13 (step 502). After the trigger coin has entered bag #2, the controller 300 then actuates the motor 158 which moves flipper 156 to the position allowing for coins to be discharged into bag #1 (step 504). The entire algorithm from step 480 to step 504 is then repeated except the bag numbers are reversed.

If the single bag clamping mechanism 220 is used, the process is similar except the controller 300 checks to the ensure that the full bag is replaced after each EBS. The controller 300 then monitors the bag interlock mechanism (contact 235 and lever 232) and ensures that a closed circuit is achieved (the full bag is removed such that lever 232 engages contact 235 as shown in FIG. 12A and 12B). Once this condition is achieved, the controller 300 then determines if the bag interlock mechanism has an open circuit (new bag between lever 232 and contact 235). Once the open circuit is detected, the controller 300 instructs the user that he or she may now continue operation with the coin sorter.

Figure 24:
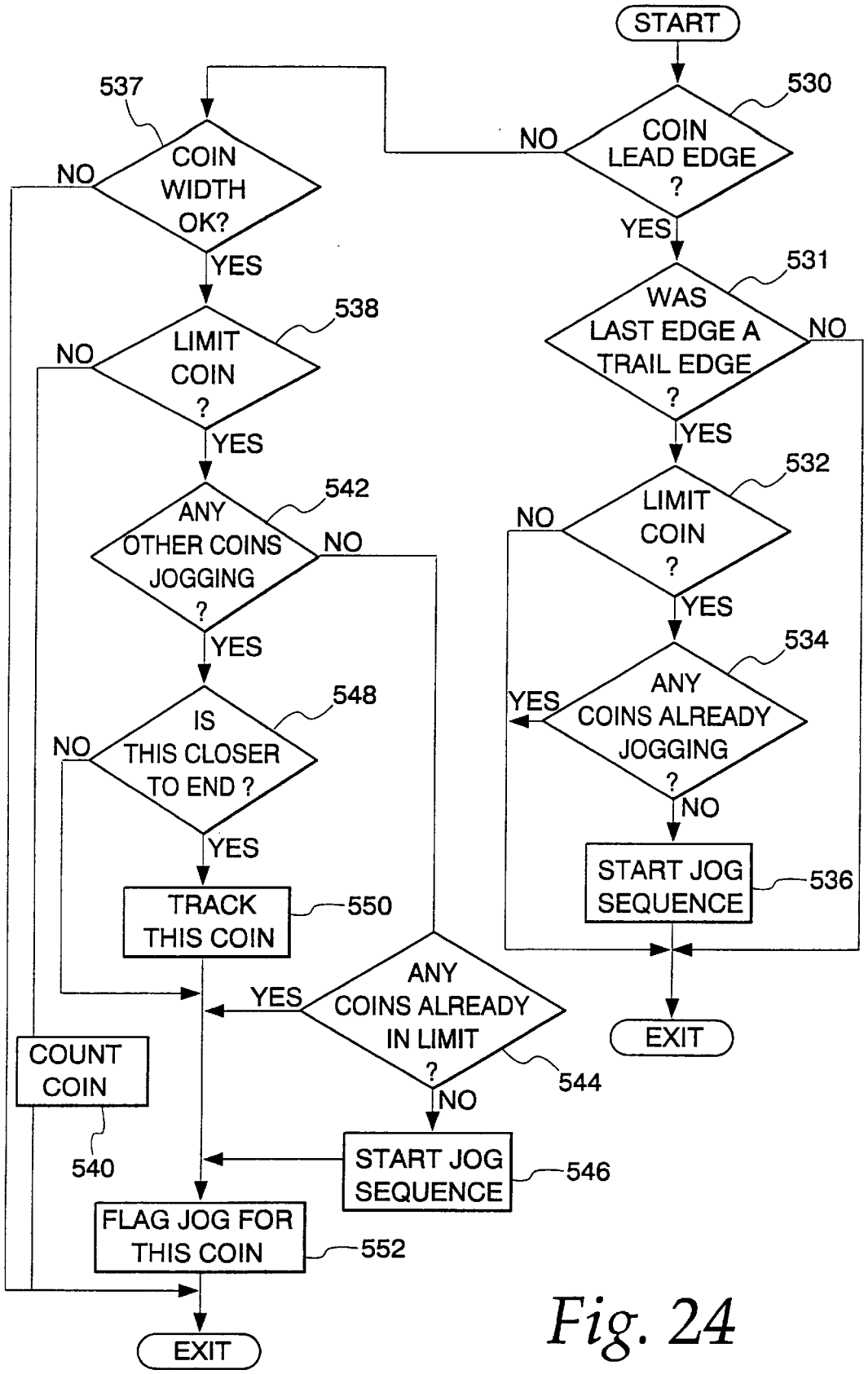
FIG. 24 is a flow chart of a program which the controller uses to control the disc drive motor and brake mechanisms in a coin sorter of FIG. 1.
Figure 25:
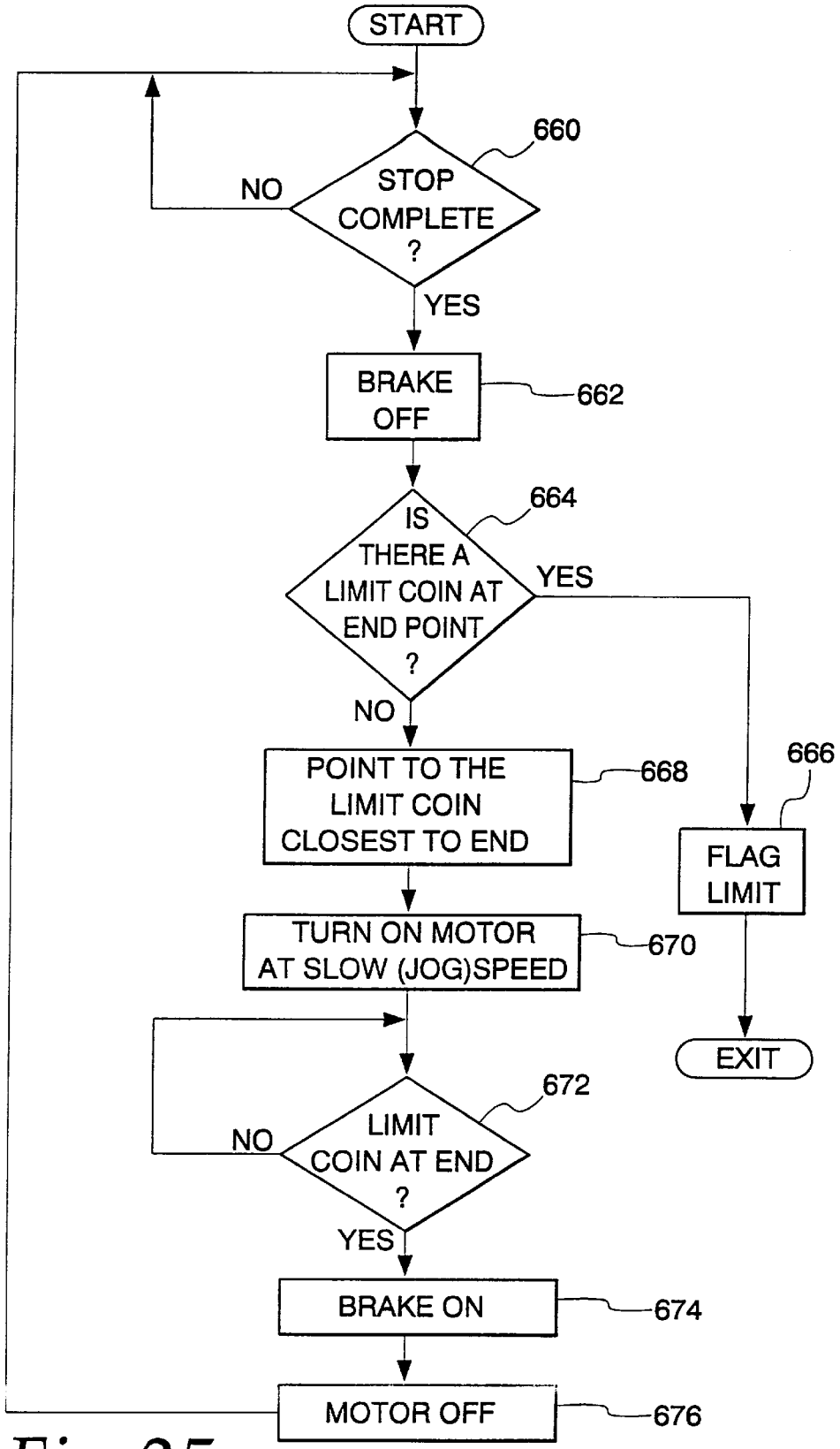
FIG. 25 is a flow chart of a jogging sequence subroutine initiated by the program of FIG. 24.
Figure 26:
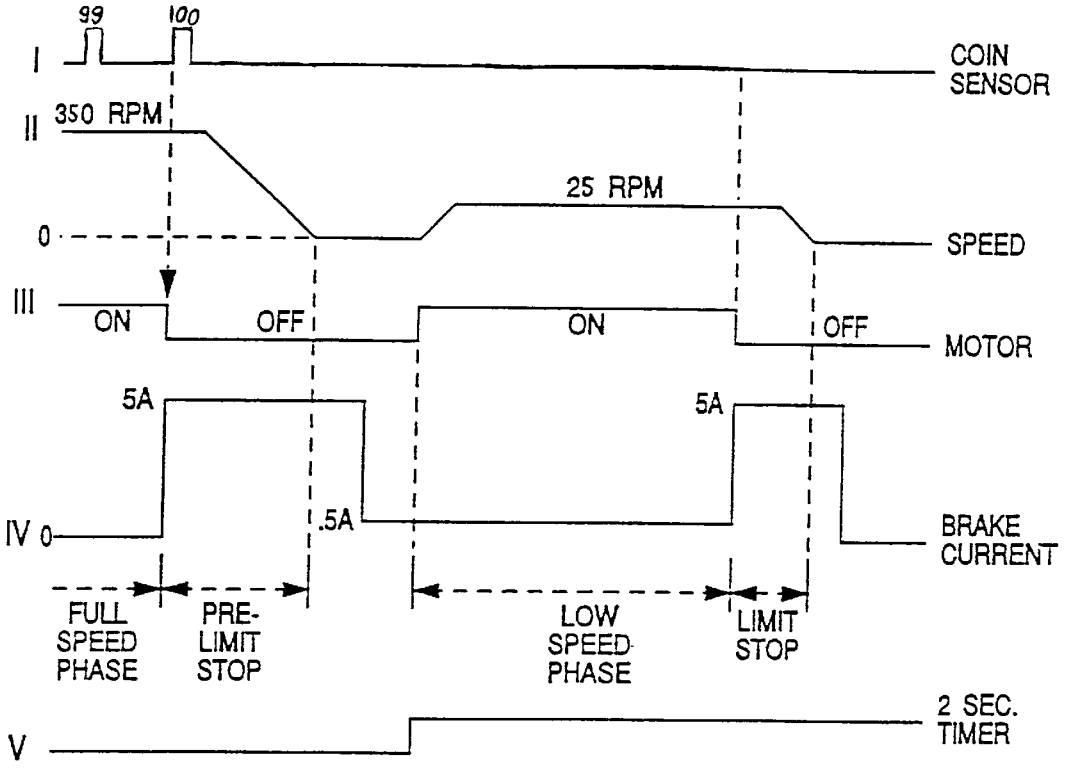
FIG. 26 is a timing diagram illustrating the operations controlled by the jogging sequence subroutine of FIG. 25.

FIGS. 24–26 illustrate the sequence of operations used by the controller 300 when counting the coins to accomplish an EBS. Having the exit edge 41*a*–49*a* of an exit channel 41–49 perpendicular to the side walls of the exit channel 41–49 is advantageous when the last coin to be discharged from the exit channel 41–49 is followed closely by another coin. That is, a leading coin can be completely released from the channel while the following coin is still completely contained within the channel. For example, when the last coin in a desired batch of n coins is closely followed by coin n+1 which is the first coin for the next batch, the disc 13 must be stopped after the discharge of coin n but before the discharge of coin n+1. This can be more readily accomplished with exit channels 41–49 having exit edges perpendicular to the side walls.

As soon as any one of the counting sensors 121*a*–129*a* detects the last coin in a prescribed count, the disc 13 is stopped by de-energizing or disengaging the drive motor 14 and energizing a brake mechanism 36 and 14*a*. In a preferred mode of operation, the disc 13 is initially stopped as soon as the trailing edge of the "last" or nth coin clears the sensor, so that the nth coin is still well within the exit channel when the disc 13 comes to rest. The nth coin is then discharged by jogging the drive motor 14 with one or more electrical pulses until the trailing edge of the nth coin clears the exit edge of its exit channel. The exact disc movement required to move the trailing edge of a coin from its sensor to the exit ledge 41*a*–49*a* of its exit channel 41–49, can be empirically determined for each coin denomination and then stored in the memory of the controller 300. The encoder pulses are then used to measure the actual disc movement following the sensing of the nth coin, so that the disc 13 can be stopped at the precise position where the nth coin clears the exit ledge 41*a*–49*a* of its exit channel 41–49, thereby ensuring that no coins following the nth coin are discharged.

The flow chart of a software routine for controlling the motor 14 and brake mechanisms 14*a* and 36 following the sensing of the nth coin of any denomination is illustrated in FIGS. 24–25, and a corresponding timing diagram are shown in FIG. 26. This software routine operates in conjunction with the controller 300 receiving input signals from the nine counting sensors 121*a*–129*a* and the encoder sensor 32, as well as manually set limits for the different coin denominations. Output signals from the controller 300 are used to control the drive motor 14, the brake mechanism 36 for the disc 13, and the motor brake mechanism 14*a*. The routine charted in FIG. 24 is entered each time the output signal from any of the counting sensors 121*a*–129*a* changes, regardless of whether the change is due to a coin entering or leaving the field of the sensor. The controller 300 can process changes in the output signals from all nine sensors in less time than is required for the smallest coin to traverse its sensor.

FIGS. 24 and 25 show a preferred operation in which the controller 300 controls the coin sorting system when sorting and counting coins of multiple denominations. FIG. 24 shows the flow for the main program beginning at a point in which the coin sensor 121*a*–129*a* for a particular coin denomination indicates that a coin has been sensed. The sensing of the coin is detected by the leading or trailing edge of the coin with the sensor 121*a*–129*a* located off center from the coin path. In this way, two coins traveling back-to-back are separately detected.

At block 530 of FIG. 24, the controller performs a test to determine if the coin leading edge or the coin trailing edge has been sensed. The change in the sensor output is different when metal leaves the field of the sensor than when metal enters the field. If the answer at step 530 is affirmative, the routine advances to step 531 to determine whether the previous coin edge detected by the same sensor was a trailing edge of a coin. A negative answer at step 531 indicates that the sensor output signal which caused the system to enter this routine was erroneous, and thus the system immediately exits from the routine. An affirmative answer at step 531 confirms that the sensor has detected the leading edge of a new coin in the exit channel 41–49. If the coin leading edge is sensed and the last edge sensed previously was a trail edge, flow proceeds from block 531 to block 532 where another test is performed to determine if the coin for the particular coin denomination is the limit coin. If the sensed coin is not the limit coin, flow proceeds from block 532 to the end of the flow chart for exiting this section of the program. The program section is exited at this point, because coins are only counted when their trailing edge is sensed.

If the sensed coin is the limit coin, flow proceeds from block 532 to block 534 to determine whether any coins are already jogging, that is to say, moving on the disc 13 at the jogging speed. If the disc 13 is not already operating at the jog speed, flow proceeds from block 534 to block 536 to begin the jog operation. If there are coins already jogging, flow proceeds to the end of the program section for exiting.

Referring back to the decision block 530, if the sensed coin does not correspond to the coin leading edge, flow then proceeds to block 537 wherein the width of the coin is checked by determining whether the proper number of encoder pulses has been counted by the controller 300 in the interval between the leading-edge detection previously detected and the trailing-edge detection. A negative answer at block 537 causes the controller 300 to conclude that the sensor output signal which caused the system to enter this routine was erroneous, and thus the routine is exited.

An affirmative answer at block 537 confirms the legitimate sensing of both the leading and trailing edges of a new coin moving in the proper direction through its respective exit channel 41–49, and thus the routine advances to block 538 where a test is performed to determine if the sensed coins for the particular coin denomination (corresponding to the sensor location) is the limit coin. This block corresponds exactly to block 532, as previously discussed. If this is not the limit coin that has been sensed, flow proceeds from block 538 to block 540 where the sensed coin is counted by the controller 300. As previously mentioned, the coins are counted in response to sensing their trailing edge. After counting the coin at block 540, this section of the program is exited.

At block 538, if the sensed coin is the limit coin, flow proceeds from block 538 to block 542 to perform a test concerning whether there are coins of other denominations that have prompted the jog sequence. Thus, at block 542, the controller 300 queries whether any other coins are already jogging. If no other coins are jogging, flow proceeds from block 542 to block 544 where the controller 300 performs a test to determine if there are other coins (of other denominations) in the limit, i.e., whether coins of other denominations have been sensed as limit coins. If not, there is no conflict and flow proceeds from block 544 to block 546 where the jog sequence for the limit coin of this sensed coin denomination begins.

At block 542, if there are coins of other denominations already in the jog sequence, flow proceeds from block 542 to block 548 where the controller 300 performs a test to determine which limit coin (of the respective denominations) is closest to being discharged. If this most recently sensed coin is the closest to being discharged, flow proceeds from block 548 to block 550 where the controller 300 tracks this coin using the encoder 30 in conjunction with the encoder sensor 32. If this coin is not the closest to being discharged, flow proceeds from block 548 (skipping block 550) on to block 552. Block 550 is skipped in this event, because a limit coin of another denomination is already being tracked by the controller 300. Thus, from block 546 or from block 550, flow proceeds to block 552 where a flag is set to indicate that this sensed coin (for this particular denomination, should be in the jog sequence for proper discharge. Using this flag, the controller 300 is able co perform the determination discussed in connection with block 544, that is to say, whether there are any other coins (of other denominations) in the limit. From block 552, flow proceeds to exit from this section of the program.

Referring now to the flow chart depicted in FIG. 25, this is the jog sequence operation that is executed in blocks 536 and 546 of the flow chart of FIG. 24. The speed of the disc 13 has been reduced by applying the brake mechanisms 14*a* and 36 and limiting the power to the motor 14. A decision is then performed at block 660 to determine if the rotation of the disc 13 has completely stopped. If not, flow continues in a loop around 660 until the controller 300 determines from the inputs of the encoder sensor 32 that the disc 13 is completely stopped. From block 660, flow proceeds to block 662 where the controller 300 commands release of the brake mechanisms 14*a* and 36. From block 662, flow proceeds to block 664 where the controller 300 performs a decision to determine if there is a limit coin at the end point, that is already discharged. If there is a limit coin at the end point, flow proceeds from block 664 to block 666 where a flag is set to indicate that the coin is discharged. The flag of block 666 is used in conjunction with block 542 of FIG. 25 to indicate that there are no longer any coins jogging. From block 666, flow proceeds to execute an exit command to exit from this jog sequence routine. An exit at this point corresponds to a termination of either block 536 or block 546 in FIG. 25.

From block 664, flow proceeds to block 668 when the controller 300 determines that there is no limit coin at the end point. At block 668, the controller 300 uses the inputs from the encoder sensor 32 to track the limit coin closest to the end point. From block 668, flow proceeds to block 670 where the motor 14 is jogged (pulsing for an AC motor or variably controlling the power for a DC motor) to slowly direct the coin closest to the end point to the end. From block 670, flow proceeds to block 672 where the controller 300 performs a test to determine if the limit coin is at the end point. If not, flow remains in a loop around block 672 until this limit coin is discharged which is known to occur after a predetermined number of encoder pulses. From block 672, flow proceeds to block 674 where the brake mechanisms 14*a* and 36 are applied at full force, and on to block 676 wherein the motor 14 is turned off. From block 676, flow returns to the top of this routine (block 660) to determine if the jogging speed has come to a stop. In a reiterative manner, blocks 660 through blocks 676 are executed again after the user has cleared the insert limit coin's container or coin bag until all of the limit coins for the respective denominations are discharged.

FIG. 26 illustrates the timing for the jogging sequence in FIG. 25 for the coin sorter system. The first line of the timing diagram of FIG. 26, depicted by I, represents the signal output from one of the coin sensors 121*a*–129*a* and uses the one-hundredth coin of a particular coin denomination as the limit coin for purposes of this example. The second and third lines II and III of the timing diagram represent, respectively, the speed of the motor 14 and the power control signal (ON or OFF) to the motor 14. The controller 300 controls the speed of the motor 14 by using the power control signal (line III) to turn the power to the motor 14 on and off and to selectively actuate the brake mechanisms 14*a* and 36. The timing and magnitude of the current to the braking mechanisms 14*a* and 36 are shown on line IV. Line V represents an internal timing signal used by the controller 300 to determine if a jam has been detected after sensing the limit coin.

Assuming that the controller 300 has been programmed with the one-hundredth coin of a particular denomination as the limit coin of that denomination, the controller 300 runs the motor 14 at full speed until the limit coin is sensed by one of the coin sensors 121*a*–129*a*. When the limit coin has been sensed, the controller 300 initiates immediate deceleration of the rotating disc 13, so as to undergo the jogging sequence such that only the limit coin is discharged and not any coins beyond the limit coin.

To achieve this goal, in response to sensing the limit coin while in a Full Speed Phase, the controller 300 sends a signal to a relay or solenoid or other device (not shown in the figures) to shut down power to the motor 14 which corresponds to block 660 in FIG. 25. The timing for this shutdown signal is shown on line III of FIG. 26 in the first falling edge of the motor power control signal. At essentially the same time the power to the motor 14 is interrupted, the controller 300 sends a signal to the brake mechanisms 14*a* and 36 so as to apply maximum braking force against the rotating disc 13 (e.g. 5 amps). The timing for this signal is shown on line IV as the first rising edge of the brake current signal. A short time later, the rotating disc 13 is brought from full speed (e.g., 350 RPM) to a static position (known as a Pre-Limit Stop since the limit coin has not yet been discharged) as indicated by the second horizontal line on the speed plot of line II.

A short time after the disc 13 is halted, the controller 300 sends a signal to reduce the braking current to a range which is typically between 0 and 0.5 amp. The reduced braking current is typically not enough current to provide a braking force against the disc 13. The timing for this signal is shown on line IV as the first falling edge of the brake current signal. With the braking force at this reduced level, the controller 300 next turns the motor 14 on again and simultaneously activates a two-second internal timer. The disc 13 begins rotating again but at a Low Speed Phase (e.g. 25 RPM).

The disc 13 rotates at this low speed for a specified number of encoder pulses which is known to discharge a coin for a particular denomination. At this step, the controller 300 receiving the encoder pulses detected by the encoder sensor 32 corresponds to block 672 in FIG. 25. After this Low Speed Phase during the specified period of time, the power to the motor 14 is deactivated and the braking mechanisms 14*a* and 36 apply braking force. When the appropriate number of encoder pulses are detected, the limit coin should have been discharged from the disc 13 and the coin sorter comes to Limit Stop.

Alternatively, if the two second timer (line V) decrements to 0 before the appropriate number of encoders pulses are detected, then an error message is shown indicating that a jam has likely occurred since the disc 13 has not rotated the proper amount although power was applied to the motor 14.

Figure 27A:
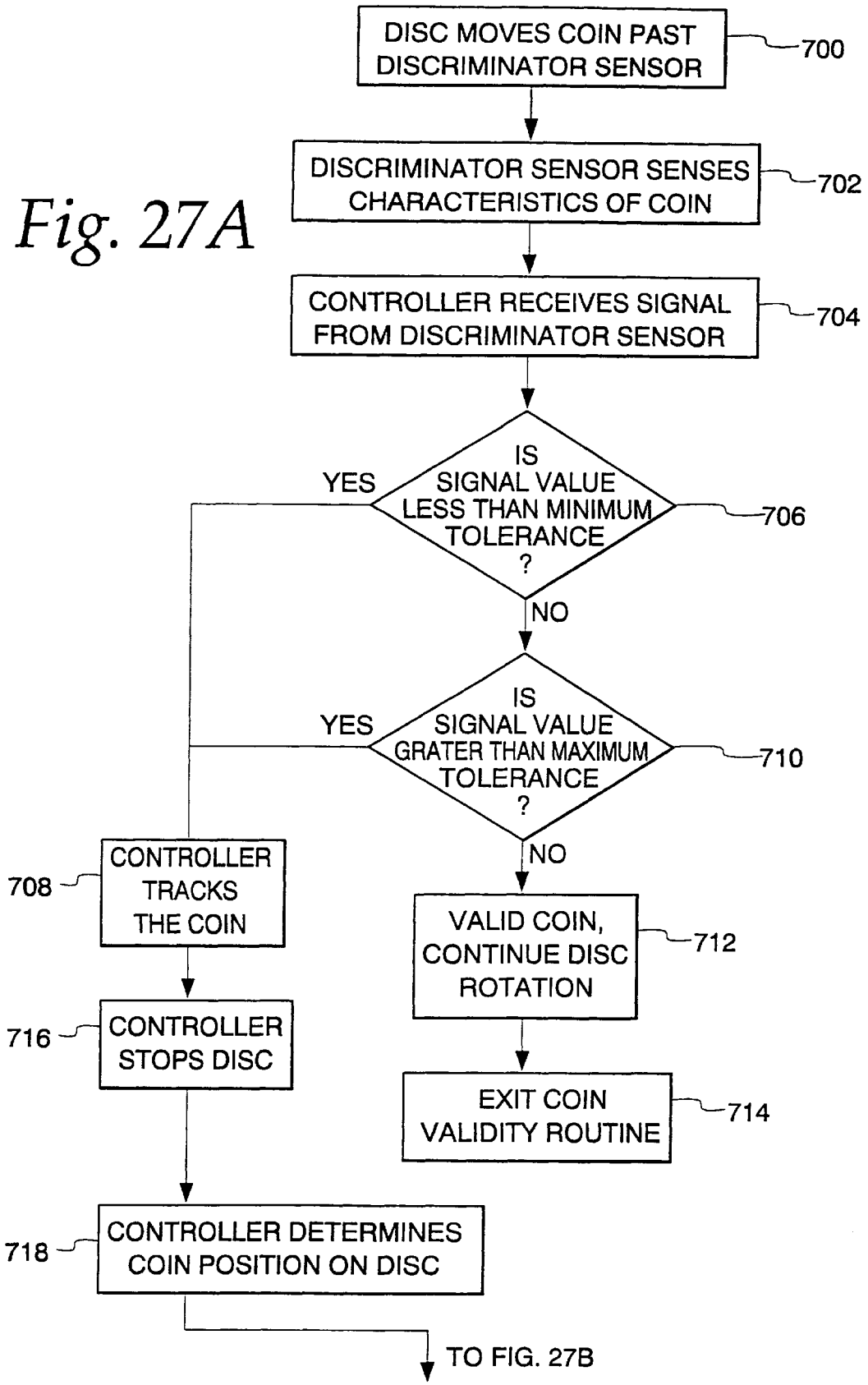
FIGS. 27A–27B are flow charts of the sequence of events which occur when an invalid coin is detected.
Figure 27B:
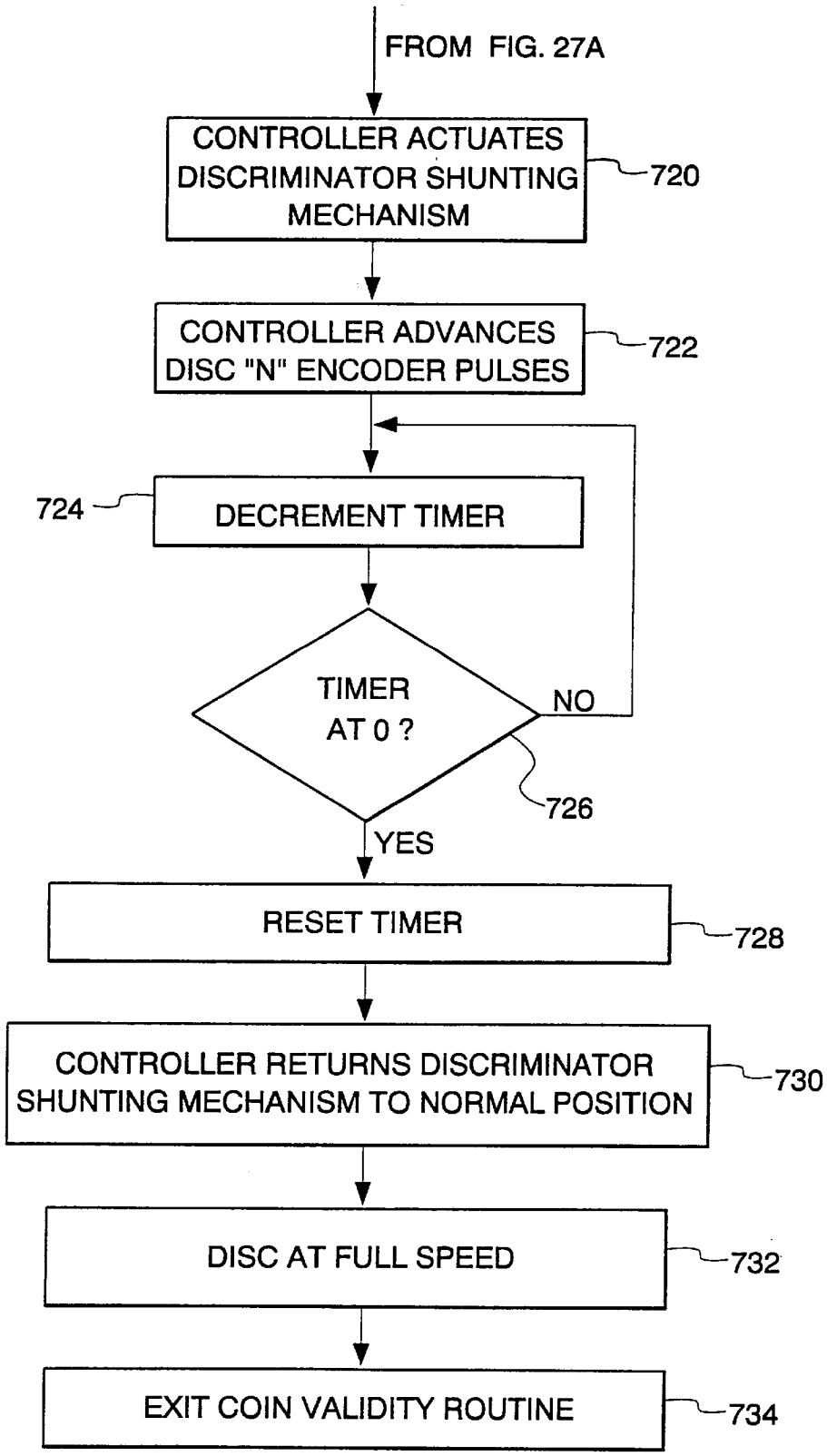

FIGS. 27A and 27B illustrate the stopping procedure which occurs when an invalid coin is detected. As the disc 13 moves a coin past one of the discriminator sensors 121*b*–129*b* (step 700), the discriminator sensor senses the characteristics of the coin (step 702) and the controller 300 receives the signal from the discriminator sensor (step 704). The controller 300 then compares the received signal with the characteristic pattern which it has stored in its memory.

The controller 300 first checks whether the signal value is less than the lower limit stored within its memory (step 706). If the signal value is less than the lower limit, then the controller 300 begins to track the coin (step 708).

On the other hand, if the signal value is greater than the lower limit in step 706, then the controller 300 compares the signal to the upper limit of the characteristic pattern which it has stored in its memory (step 710). If the signal value is greater than the upper limit, then the controller 300 again begins to track the coin (step 708). However, if the controller 300 determines the signal value is less than the upper limit, then the coin in question is valid and the disc 13 continues rotation (step 712). The controller 300 then exits the coin validity subroutine (step 714).

A coin that is outside of the limits stored within the memory of the controller 300 is tracked at step 708 by knowing the position at which it was originally sensed and the amount of pulses received from the encoder sensor 32 after the coin was sensed. The controller 300 then stops the disc 13 (step 716) and determines the coin position on the disc 13 which is now at a complete stop (step 718).

Because another invalid coin or the bag limit coin for a denomination can be detected within the period of time before the disc 13 comes to a complete stop, the controller 300 must give preference to the coin which is closest to being discharged and proceeds within this subroutine accordingly if that coin is an invalid coin. Alternatively, FIGS. 24–26 are used if that preferential coin is the last coin to enter the bag for an exact bag stop function.

In any event, once the controller 300 knows of the position of the invalid coin after the disc 13 is stopped (step 718) via the brake mechanisms 14*a* and 36, the controller 300 actuates the discriminator shunting mechanism (flipper 156 connected to the shunting motor 135 in FIGS. 10A–10D) at step 720. The controller 300, knowing the position of the invalid coin, advances the disc 13 by "N" encoder pulses to expel the invalid coin (step 722). Because, there is a time lag between the controller 300 advancing the disc 13 and the invalid coin entering the invalid coin exit chute (second chute 138 in FIG. 10B), a timer is decremented from a predetermined value (step 724) after the disc 13 begins to advance. The predetermined value of the timer is dependent on the distance between the periphery of the disc 13 and the discriminator shunting mechanism. Typically, the distance between the periphery of the disc 13 and the flipper within the discriminator shunting mechanism is in the range from about 0.1 inch to about 6.0 inches.

When the timer reaches zero seconds after advancing the disc 13 (step 726), the invalid coin has passed into the invalid coin exit chute. The timer is then reset to its predetermined value (step 728). The controller 300 returns the discriminator shunting mechanism to its normal position (first chute 137 in FIG. 10C) at step 730. The disc 13 is returned to full speed (step 732), and the controller 300 exits the validity subroutine (step 734).

Figure 28A:
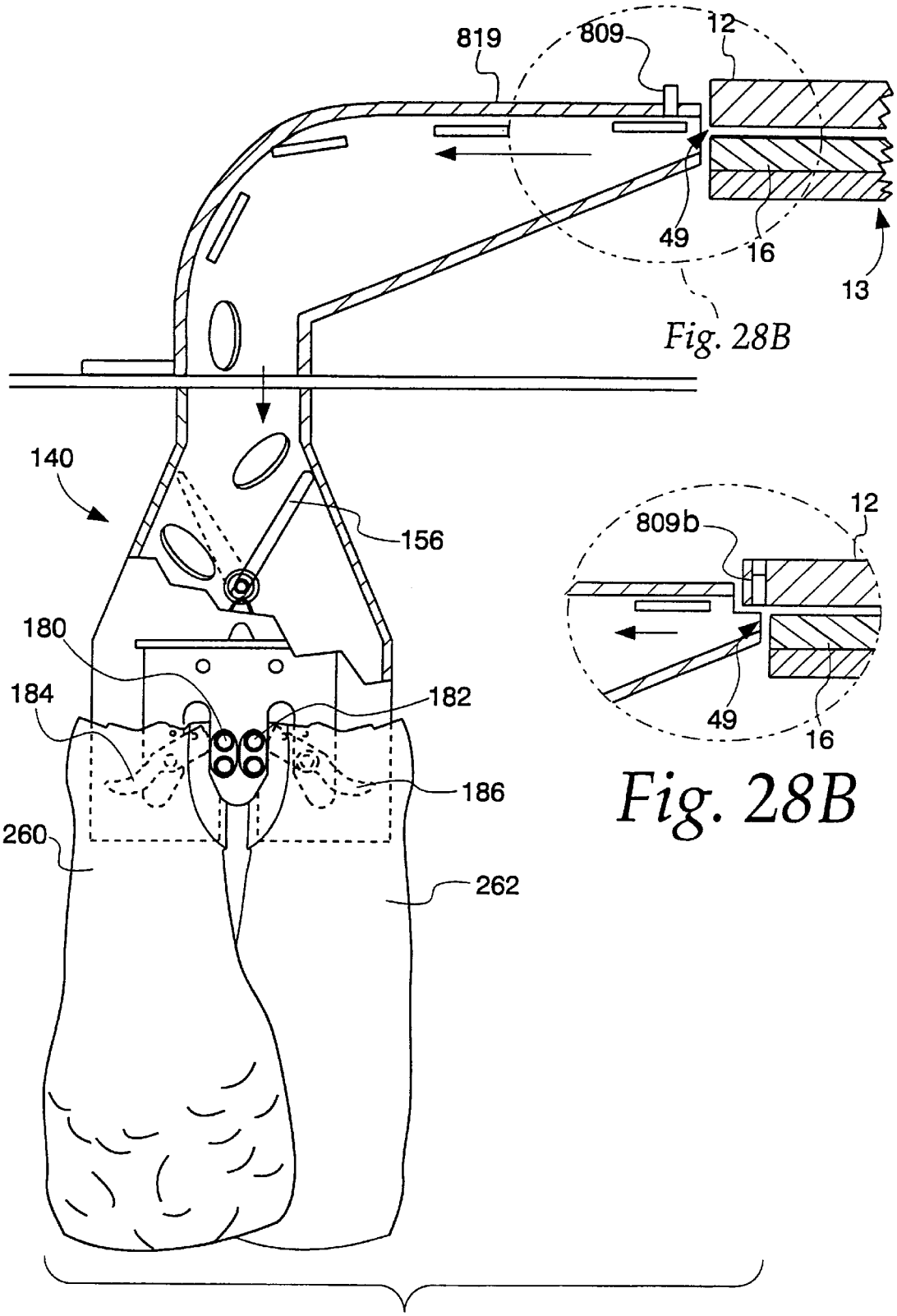
FIG. 28A is an alternative embodiment of the coin sorter of FIG. 1 in which the sensors are outboard of the periphery of the disc and within respective coin chutes.

FIG. 28A illustrates an alternative coin sorting system in which coin sensors are located external from the periphery of the sorting head 12. The sorting head 12 shown in FIGS. 3 and 4 is exactly the same except that counting sensors 121*a*–129*a* are not present. As shown in FIG. 28A, however, a counting sensor 809 is positioned in an exit chute 819 located adjacent the exit channel 49. Each exit channel 41–49 has a corresponding coin sensor disposed with a corresponding exit chute. As each coin exits the periphery of the sorting head 12 and the disc 13, the counting sensor 809 detects the coin and sends a signal to the controller 300 to which it is coupled. The coins then enter the bag clamping mechanism 140 which is described in reference to FIGS. 11A and 11B. The operation of the bag clamping mechanism 140 is no different in this embodiment than the embodiment described above. Further, the single chute bag clamping mechanism 220 described in FIGS. 12A and 12B could be used with this embodiment as well.

In the previous embodiment, when one of the counting sensors 121*a*–129*a* detected the trigger coin (last coin to enter the bag) for the EBS feature, the disc 13 stopped completely, or at least decelerated, such that only that trigger coin entered the bag and the coin following the trigger coin remained on the disc 13. However, this was possible because the counting sensors 121*a*–129*a* detected the trigger coin while it was on the disc 13 within the sorting head 12. In the embodiment of FIG. 28A, the sensors 809 can not detect the trigger coin until it is in the exit chute 819 which means that the coin following the trigger coin may already be on its way into the exit chute 819 before the disc 13 can be stopped and the flipper 156 is switched to its alternative position shown in phantom lines.

To overcome this problem, the controller 300 performs the following algorithm. For this algorithm, dimes will be used as an example with the bag limit set at 10,000 dimes per bag. When the counter within the controller 300 reaches a value that is close to the bag limit value (e.g. 9,950 dimes), the controller 300 recognizes that it will soon be performing the exact bag stop function for dimes. Thus, the controller 300 then slows the speed of the disc 13 by use of the braking mechanisms 14*a* and 36 or decreasing the power to the motor 14. When the number of dimes in the bag is closer to the limit (e.g. 9,990 dimes), the controller 300 further slows the disc 13. When the number of dimes is even closer to the limit (e.g. 9,999 dimes), the controller 300 further slows the disc 13 such that coins are being discharged very slowly. When the sensor 509 detects the 10,000th dime, the controller 300 immediately stops the disc 13 and the flipper 156 is switched such that the remaining dimes enter the bag 262 instead of full bag 260. The controller 13 then instructs the disc 13 to continue rotation at full speed by disengaging the brake mechanisms 14*a* and 36 or returning full power to the motor 14.

Considering that up to nine denominations may be encountering an exact bag stop within a relatively close time period, the controller 300 gives preference in the deceleration process to the denomination that is nearest to encountering its exact bag stop. It is possible that a first denomination is initially flagged by the controller 300 as nearing an exact bag stop, but a second denomination overtakes the first denomination in preference by the controller 300 due to more coins of the second denomination being sorted. By providing this preference, it is assured that an exact bag stop occurs for all denominations.

Although this algorithm has been described with three distinct deceleration steps and one complete stop, it will be appreciated that this process could be limited to one deceleration step and one complete stopping step if the braking mechanisms 14*a* and 36 apply a substantial braking force.

Furthermore, the embodiment in FIG. 28A can also include the discriminator sensors 121*b*–129*b* in the exit channels 41–49. Thus, the exit chutes could be replaced with the coin chutes 51–59 (FIGS. 10A–10D) having the flipper 136 as the discriminator shunting mechanism. Alternatively, the discriminators could be outside the periphery of the disc 13 and the sorting head 12. If a discrimination diverter is placed in the coin path at a position sufficiently away from the discriminator sensor, then it would be possible to divert an invalid coin after it is detected. Such a diverter may even be placed within the two chutes beyond the flipper 156 which diverts coins to a location outside of the bags.

FIG. 28B is an alternative embodiment to FIG. 28A which merely places a sensor 809*b* in the sorting head 12 outside the periphery of the rotating disc 13. However, the same type of deceleration algorithm described in reference to FIG. 28A can be used with this embodiment as well.

The coin sorter described above with reference to FIGS. 1–27 has included features which are applicable to coin sorters having a sorting head 12 with any diameter—9 inches, 11 inches, 13 inches or larger. Preferably, the coin sorter described herein has a sorting head 12 which has a diameter of approximately 13 inches. At this size, nine denominations are able to be processed at extremely high speeds and with a high degree of accuracy. For example, until now, the highest rate at which coins of mixed denominations could be sorted, counted, placed into bags with the exact bag stop (EBS) feature, and retain an invalid coin within the coin sorter after it is detected was 600 per minute. With the coin sorter described above, the rate is in excess of approximately 2000 coins per minute.

Furthermore, until now, the fastest rate at which coins of mixed denominations could be sorted, counted, and have invalid coins discriminated from valid coins was 3000 coins per minute. With this coin sorter, the rate at which this can be accomplished is in excess of approximately 3500 coins per minute.

Lastly, until now, the highest rate at which coins of mixed denominations were sorted and counted with the EBS feature without any invalidity discrimination was 3000 coins per minute. With this coin sorting machine, the rate at which coins of mixed denominations can be sorted and counted with the EBS feature is in excess of approximately 4000 coins per minute.

While the invention is susceptible to various modifications and alternative forms, specific embodiment thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

We claim:

1. A coin sorting system, comprising:

a coin sorter for sorting a plurality of coins of mixed denominations, said coin sorter including a coin-driving member having a resilient surface and a stationary coin-guiding member having a coin-guiding surface opposing said resilient surface of said coin-driving member, said coin-guiding surface being positioned generally parallel to said resilient surface, said resilient surface of said coin-driving member moving the coins along said coin-guiding surface of said coin-guiding guiding member, said coin-guiding surface forming a plurality of exit stations for selectively allowing exiting of the coins based upon their respective diameters;

a coin sensor for sensing a trigger coin while said trigger coin is moving along said coin-guiding surface of said coin-guiding member;

an encoder for monitoring the movement of said trigger coin downstream of said coin sensor by tracking the movement of said coin-driving member in terms of encoder pulses;

a braking mechanism coupled to said coin-driving member;

a controller coupled to said coin sensor, said encoder, and said braking mechanism, said controller causing said braking mechanism to decelerate and stop said coin-driving member in a preselected number of encoder pulses in response to said trigger coin being sensed by said coin sensor so that said coin-driving member stops just prior to or just after said trigger coin is discharged from its associated exit station; and an operator interface panel coupled to said controller, said operator interface panel including means for altering said preselected number of encoder pulses.

2. The coin sorting system of claim 1, wherein said coin-driving member includes a rotatable disc and said coin-guiding member includes a stationary head positioned above said rotatable disc, said plurality of exit stations including a plurality of exit channels opening at a periphery of said stationary head.

3. The coin sorting system of claim 1, wherein said coin sensor includes a discriminator for discriminating between valid and invalid coins, said trigger coin being an invalid coin, said braking mechanism stopping said coin-driving member just prior to said trigger coin being discharged from its associated exit station.

4. The coin sorting system of claim 1, wherein said coin sensor includes a counting sensor allowing said controller to count coins sensed by said counting sensor, said trigger coin being the last coin in a predetermined number of coins counted by said controller, said braking mechanism stopping said coin-driving member just after said trigger coin is discharged from its associated exit station.

5. The coin sorting system of claim 1, wherein said encoder includes an optical sensor positioned adjacent to said coin-driving member and a plurality of uniformly spaced indicia on said coin-driving member.

6. A coin sorting system, comprising:

a coin sorter for sorting a plurality of coins of mixed denominations, said coin sorter including a coin-driving member having a resilient surface and a stationary coin-guiding member having a coin-guiding surface opposing said resilient surface of said coin-driving member, said coin-guiding surface being positioned generally parallel to said resilient surface, said resilient surface of said coin-driving member moving the coins along said coin-guiding surface of said coin-guiding member, said coin-guiding surface forming a plurality of exit stations for selectively allowing exiting of the coins based upon their respective diameters;

an encoder for tracking the movement of said coin-driving member in terms of encoder pulses;

a braking mechanism coupled to said coin-driving member;

a controller coupled to said braking mechanism and said encoder, said controller causing said braking mechanism to decelerate and stop said coin-driving member in a preselected number of encoder pulses in response to a predetermined event; and an operator interface being coupled to said controller and including means for altering said preselected number of encoder pulses.

7. The coin sorting system of claim 6, wherein said coin-driving member includes a rotatable disc and said coin-guiding member includes a stationary head positioned above said rotatable disc, said plurality of exit stations including a plurality of exit channels opening at a periphery of said stationary head.

8. The coin sorting system of claim 6, further including a coin sensor for sensing a trigger coin, said controller being coupled to said coin sensor, and wherein said predetermined event is sensing said trigger coin.

9. The coin sorting system of claim 8, wherein said trigger coin is an invalid coin.

10. The coin sorting system of claim 8, wherein said trigger coin is a last coin in a preselected count of coins.

11. A method of sorting a plurality of coins of mixed denominations in a coin sorter, said coin sorter including a coin-driving member having a resilient surface and a stationary coin-guiding member having a coin-guiding surface opposing said resilient surface of said coin-driving member, said coin-guiding surface being positioned generally parallel to said resilient surface, said coin-guiding surface forming a plurality of exit stations for selectively allowing exiting of the coins based upon their respective diameters, said method comprising the steps of:

moving said coin-driving member to move the coins along said coin-guiding surface of said coin-guiding member;

sorting the coins based upon their respective diameters as the coins are moved by said coin-driving member along said coin-guiding surface of said coin-guiding member;

discharging the sorted coins at respective ones of said exit stations;

using a coin sensor to sense a trigger coin while said trigger coin is moving along said coin-guiding surface of said coin-guiding member;

monitoring the movement of said trigger coin downstream of said coin sensor by tracking the movement of said coin-driving member with an encoder providing encoder pulses;

using a braking mechanism to decelerate and stop said coin-driving member in a preselected number of encoder pulses in response to said trigger coin being sensed by said coin sensor; and altering said preselected number of encoder pulses via an operator interface panel.

12. The method of claim 11, wherein said step of using a coin sensor to sense a trigger coin includes discriminating between valid and invalid coins, said trigger coin being an invalid coin, and wherein said step of using a braking mechanism to decelerate and stop said coin-driving member includes stopping said coin-driving member just prior to said trigger coin being discharged from its associated exit station.

13. The method of claim 11, further including a step of counting a predetermined number of coins sensed by said coin sensor, said trigger coin being the last coin in said predetermined number of coins, and wherein said step of using a braking mechanism to decelerate and stop said coin-driving member includes stopping said coin-driving member just after said trigger coin is discharged from its associated exit station.

14. The method of claim 11, wherein said encoder includes an optical sensor positioned adjacent to said coin-driving member and a plurality of spaced indicia on said coin-driving member.

15. A method of sorting a plurality of coins of mixed denominations in a coin sorter, said coin sorter including a coin-driving member having a resilient surface and a stationary coin-guiding member having a coin-guiding surface opposing said resilient surface of said coin-driving member, said coin-guiding surface being positioned generally parallel to said resilient surface, said coin-guiding surface forming a plurality of exit stations for selectively allowing exiting of the coins based upon their respective diameters, said method comprising the steps of:

moving said coin-driving member to move said coins along said coin-guiding surface of said coin-guiding member;

sorting said coins based upon their respective diameters as said coins are moved by said coin-driving member along said coin-guiding surface of said coin-guiding member;

discharging said sorted coins at respective ones of said exit stations;

using a single coin sensor that is spaced away from said exit station by a distance less than a diameter of a coin associated with said exit station to sense a first trigger coin after said first trigger coin is released from said coin-driving member and discharged from a respective one of said exit stations, said first trigger coin being a coin preceding a last coin in a predetermined number of coins for a particular denomination; and using a braking mechanism to decelerate said coin-driving member from an operational speed to a slower speed in response to said first trigger coin being sensed by said coin sensor.

16. The method of claim 15, wherein said coin-driving member includes a rotatable disc and said coin-guiding member includes a stationary head positioned above said rotatable disc, said plurality of exit stations including a plurality of exit channels opening at a periphery of said stationary head.

17. The method of claim 16, further including the step of using said braking mechanism to stop said coin-driving member in response to said last coin being sensed by said coin sensor.

18. The method of claim 16, further including the step of using said braking mechanism to further decelerate and maintain said coin-driving member at a second slower rate in response to said last coin being sensed by said coin sensor.

19. The method of claim 16, wherein said step of moving said coin-driving member includes the step of applying power to a motor coupled to said coin-driving member, and further including the step of reducing said power to said motor to decelerate said coin-driving member and maintain said coin-driving member at a slower rate in response to said first trigger coin being sensed by said coin sensor.

20. The method of claim 17, wherein said step of moving said coin-driving member includes the step of applying power to a motor coupled to said coin-driving member, and further including the steps of:

reducing said power to said motor to decelerate said coin-driving member and maintain said coin-driving member at said slower rate in response to said first trigger coin being sensed by said coin sensor, and reducing said power to said motor to stop said coin-driving member in response to said last coin being sensed by said coin sensor.

21. The method of claim 18, wherein said step of moving said coin-driving member includes the step of applying power to a motor coupled to said coin-driving member, and further including the steps of:

reducing said power to said motor to decelerate said coin-driving member and maintain said coin-driving member at said slower rate in response to said first trigger coin being sensed by said coin sensor, and reducing said power to said motor to further decelerate and maintain said coin-driving member at said second slower rate in response to said last coin being sensed by said coin sensor.

22. The method of claim 15, wherein said step of discharging said sorted coins includes the step of directing said sorted coins for a particular denomination including said first trigger coin and said last coin to a first coin collection receptacle, and further including the step of:

diverting the coins for said particular denomination following said last coin to a second coin collection receptacle.

23. The method of claim 16, further including the steps of:

using said coin sensor to sense a second trigger coin, said second trigger coin being a coin preceding said last coin in said predetermined number of coins for said particular denomination, and using said braking mechanism to decelerate said coin-driving member and maintain said coin-driving member at a second slower rate in response to said second trigger coin being sensed by said coin sensor.

24. The method of claim 15, wherein said first trigger coin is the coin immediately preceding said last coin in said predetermined number of coins for a particular denomination.

25. The method of claim 23, wherein said second trigger coin is the coin immediately preceding said last coin in said predetermined number of coins for a particular denomination.

26. The method of claim 23, wherein said coin sensor is located in a coin chute adjacent said coin-driving member.

27. The method of claim 23, wherein said coin sensor is located in said sorting head adjacent said coin-driving member.

* * * * *